US005681797A

United States Patent [19]

Lawate

[11] Patent Number: 5,681,797

[45] Date of Patent: Oct. 28, 1997

[54] STABLE BIODEGRADABLE LUBRICANT COMPOSITIONS

[75] Inventor: Saurabh S. Lawate, Concord, Ohio

[73] Assignee: The Lubrizol Corporation, Wickliffe, Ohio

[21] Appl. No.: 609,571

[22] Filed: Feb. 29, 1996

[51] Int. Cl.[6] ..... C10M 141/00

[52] U.S. Cl. ..... 508/280; 508/371; 508/433; 508/436; 508/452; 508/563; 508/486; 508/583; 508/584; 508/580

[58] Field of Search ..... 508/280, 371, 508/433, 436, 452, 563, 583, 584, 580, 486

[56] References Cited

U.S. PATENT DOCUMENTS

| | | | |
|---|---|---|---|
| 3,903,003 | 9/1975 | Murphy et al. | 508/507 |
| 4,122,023 | 10/1978 | Yasui et al. | 508/591 |
| 4,522,885 | 6/1985 | Funahashi et al. | 428/422 |

*Primary Examiner*—Jacqueline V. Howard
*Attorney, Agent, or Firm*—James L. Cordek; Frederick D. Hunter; Joseph P. Fischer

[57] ABSTRACT

An oxidatively stable, biodegradable lubricant composition is disclosed which comprises (A) a hydrogenated polyisoprene prepared by polymerizing isoprene such that polyisoprene is obtained wherein there are from 4 to 1000 isoprene units and hydrogenating the polyisoprene to obtain a hydrogenated polysoprene containing a residual olefinic unsaturation of not more than 10 percent based upon the unsaturation content prior to hydrogenation; and (B) at least one performance additive selected from the group consisting of
(1) an alkyl phenol;
(2) an ether;
(3) a mono- or di-substituted glyceride;
(4) a phosphorus derivative;
(5) a benzotriazole;
(6) a phosphorus amine salt;
(7) a trihydrocarbyl phosphorothionate;
(8) an aromatic amine;
(9) a zinc salt;
(10) a pour point depressant ester;
(11) a hydrogenated block copolymer; and
(12) an acrylate polymer.

In addition to components (A) and (B), the composition may also contain (C) at least one oil selected from the group consisting of (1) a triglyceride oil;

(2) a synthetic ester base oil;

(3) a polyalphaolefin; and (4) a mineral oil.

34 Claims, No Drawings

STABLE BIODEGRADABLE LUBRICANT COMPOSITIONS

FIELD OF THE INVENTION

The present invention relates to stable biodegradable lubricant compositions that contain, as a base stock, hydrogenated polyisoprenes. One hydrogenated polyisoprene is squalane which is prepared by hydrogenating squalene. Squalene is a naturally occurring product. From an environmental standpoint, it is desirable to utilize base stocks which are naturally renewable and possess a significant improvement in biodegradability over mineral oils.

BACKGROUND OF THE INVENTION

Due to growing environmental concerns, there is a need for lubricating base oils which are biodegradable. Vegetable oils and some low molecular weight poly alpha olefins and synthetic esters fulfill the biodegradability criteria when properly selected. However, these materials cannot match the oxidative stability of mineral oils, which are not biodegradable.

Some hydrogenated polyisoprenes offer a solution to these problems since they fulfill all three key criteria for lubricating base oils. They are biodegradable, have excellent low temperature properties and are oxidatively stable. Formulations containing these hydrogenated polyisoprenes thus provide lubricants with superior properties.

U.S. Pat. No. 3,475,338 (Carlos et al., Oct. 28, 1969) relates to a substantial reduction in torque that is obtained in machining metals, such as aluminum and copper, in the presence of mineral lubricating oils containing aliphatic 1,3-diene hydrocarbon unsaturated polymers, particularly hydroxyl-terminated aliphatic 1,3-diene hydrocarbon unsaturated polymers. Cutting oils, particularly suited for machining metals such as aluminum and copper, are provided by including in a mineral lubricating oil about 0.5 to 70 weight percent of an aliphatic diene unsaturated hydrocarbon polymer having the majority of its unsaturation in the main hydrocarbon chain and at least about 1.8 predominantly primary, terminal allylic hydroxyl groups per polymer molecule, and a Staudinger molecular weight of about 200 to 25,000.

U.S. Pat. No. 3,887,633 (Go et al., Jun. 3, 1975) relates to a process for preparing polymer oils and to the polymer oils and their compositions. More particularly, it relates to a process for preparing polymer oils which comprises subjecting to hydrogenation a liquid homopolymer of 1,3-pentadiene or a liquid copolymer of 1,3-pentadiene and small amounts of at least one other olefin, the homopolymer or copolymer having a number average molecular weight of from 300 to 1,000 wherein at least 70 percent of the pentadiene units is of trans structure, to the extent that the unsaturation of the original polymer is reduced to that equivalent to an iodine number of 60 or less.

U.S. Pat. No. 3,931,021 (Lundberg, Jan. 6, 1976) relates to a process for controlling the viscosity of organic liquids by incorporating in said liquid a minor amount of an ionic polymer, and a cosolvent for the ionic groups of said polymer. The ionic polymer comprises a backbone which is substantially soluble in said organic, liquid, and pendant ionic groups which are substantially insoluble in said organic liquid. A cosolvent is selected which will solubilize the pendant ionomeric groups and provide a reasonably homogeneous mixture of solvent, cosolvent and ionomeric polymer. The compositions prepared by the method of this reference comprise an organic liquid having a solubility parameter of from 6 to 10.5 in combination with a sulfonated polymer containing from 0.2 up to 10.0 mole % ionic groups which has been neutralized by a basic material selected from Groups IA and IIA, IB and IIB and also lead, tin and antimony of the Periodic Table of the Elements and a nonvolatile alcohol or amine as the cosolvent.

U.S. Pat. No. 4,060,492 (Yasui et al., Nov. 29, 1977) relates to synthetic saturated oils produced by hydrogenation of low molecular weight polyisoprene having the 1,4 structure of at least 70% in the main chains and a number average molecular weight of about 150 to 3,000. The starting material in the method of this reference is low molecular weight polyisoprene as defined above. When the 1,4 structure in the main chains is less than 70%, the resulting hydrogenation product can hardly flow or does not have a low viscosity. In general, the use of low molecular weight polyisoprene having a higher content of 1,4 structure affords a hydrogenation product of lower viscosity. Also, the use of the one having a higher content of cis structure gives a hydrogenation product of lower viscosity.

U.S. Pat. No. 4,261,841 (Gragson, Apr. 14, 1981) relates to the production of a lubricating composition. In one of its aspects it relates to a synthetic lubricating oil containing composition. More specifically it relates to a synthetic lubricating oil composition comprising a hydrogenated oligomer of a 1,3-diolefin. In one of its concepts the reference provides a composition comprising a hydrogenated oligomer of 1,3-diolefin and at least one of a neutral and an overbased calcium petroleum sulfonate. In another of its concepts the reference provides a compounded synthetic lubricating oil composition primarily and importantly containing a hydrogenated oligomer as herein described and a calcium petroleum sulfonate also as herein described.

U.S. Pat. No. 4,465,608 (Gerüm et al., Aug. 14, 1984) relates to the addition of organic boron compounds, prepared by either reacting boric acid with polyhydric alcohols having a total of 5 or more neighboring groups per boron atom and then with polyethylene oxide in a mole ratio of 1:40, based on 1 mole of borate which is obtained, and with a carboxylic acid having from 8 to 22 carbon atoms or reacting boric acid first with polyhydric alcohols having a total of 5 to 11 neighboring OH groups per boron atoms, and then with a carboxylic acid having from 8 to 22 carbon atoms, said boron compound being added, in a quantity of from 3 to 12, in particular from 3 to 6 parts, by weight, based on 100 parts, by weight, of magnetic pigments, and in particular of metal powders, to the grinding operation of the magnetic pigment dispersion and then processing in a known manner. The necessary degree of dispersion is achieved after a short grinding time compared to known dispersing agents, during which time the pigment particles which are initially lying together are separated into monodisperse individual particles. The favorable effect is expressed by improved alignment values in the finished magnetic tape.

U.S. Pat. No. 4,522,885 (Funahashi et al., Jun. 11, 1985) relates to a magnetic recording medium which comprises a substrate and a magnetic layer comprising magnetic powder and a resinous binder formed on the substrate, characterized in that the magnetic layer further comprises a lubricant and an unsaturated fatty acid ester, which is improved in durability.

U.S. Pat. No. 4,620,048 (Ver Strate et al., Oct. 28, 1986) relates to hydrocarbon solutions of polymers having improved resistance to mechanical shear and the preparation thereof. More particularly, it relates to viscosity index improving additives for mineral oils of lubricating viscosity by the addition thereto of macromolecules whereby the mineral oil is provided with increased resistance to mechanical degradation of the viscosity of said lubricating oil composition.

U.S. Pat. No. 4,737,300 (Wirth et al., Apr. 12, 1988) relates to material containing a compound of the formula

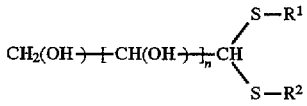

wherein n can be an integer from 2 to 6, and wherein $R^1$ and $R^2$ are identical or different, and in each case are $C_1$–$C_{18}$-alkyl, which is unsubstituted, substituted or interrupted by —O— or —S—, or are —$(CH_2$—$)_r$—$N(C_1$–$C_{17}$-alkyl$)_2$, r being 1 or 2, or are phenyl, benzyl or —$CH_2)_r$—CO—O—$R^3$, in which r can be 1 or 2 and $R^3$ is an alkali metal or $C_1$–$C_{14}$-alkyl; also wherein $R^1$ and $R^2$ are —$CH_2$—CH(OH)—$R^4$, in which $R^4$ is hydrogen, or $C_1$–$C_{16}$-alkyl, unsubstituted or substituted by —OH, or $CH_2$—Y—($C_1$–$C_{15}$-alkyl), in which Y is —O—or —S—; or wherein $R^1$ and $R^2$ together form —$(CH_2)_m$, in which m can be an integer from 2 to 4.

U.S. Pat. No. 4,754,090 (Vila Peris et al., Jan. 28, 1988) relates to a process for the preparation of 2,6,10,15,19,23-hexamethyl tetracosane and isomers thereof having a hexamethyl tetracosane structure from certain vegetable fats and oils.

U.S. Pat. No. 4,956,122 (Watts et al., Sep. 11, 199) relates to compositions useful as lubricating oils having high viscosity index, improved resistance to oxidative degradation and resistance to viscosity losses caused by permanent or temporary shear. According to this reference a lubricating composition is provided comprising (1) a high viscosity synthetic hydrocarbon such as high viscosity polyalphaolefins, liquid hydrogenated polyisoprenes or ethylenealphaolefin oligomers; (2) a low viscosity mineral oil or synthetic hydrocarbon, such as alkylated benzene or low viscosity polyalphaolefin; and/or, optionally (3) a low viscosity ester, such as monoesters, diesters, polyesters and optionally (4) an additive package.

U.S. Pat. No. 4,999,122 (Lockwood et al., Mar.12, 1991) provides novel lamellar liquid crystalline compositions and, more particularly, to provide non-aqueous lamellar liquid crystalline compositions which are useful as lubricants or as friction-modifying additives in lubricating oil compositions. The reference also provides liquid crystalline compositions which maintain liquid crystallinity over a broad temperature range. The reference further provides lamellar liquid crystal compositions which exhibit low viscosity-pressure coefficients.

U.S. Pat. No. 5,022,492 (Ohno et al., Jun. 11, 1991) relates to a dynamic pressure-type fluid-bearing apparatus which comprises a shaft, a sleeve that receives said shaft therein, dynamic pressure-generating grooves that are formed either on said shaft or on said sleeve, and a fluid lubricant that is oil, grease, or the like, wherein a single-component composition is used as the base oil or said lubricant. In a preferred embodiment, the base oil is one selected from the group consisting of squalene, trimethylolpropanetriheptylate, trimethylolpropanetrioctanate, and trimethylolpropanetrinonanate.

U.S. Pat. No. 5,366,658 (Hoppe et al., Nov. 22, 1994) relates to biodegradable base oils for lubricants and functional fluids comprising polymethylalkanes having terminal methyl groups and methylene and ethylidene groups. These polymethylalkanes are of the formula

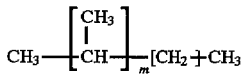

wherein the total number of C atoms (n+2m+2) is 20 to 100, preferably, 20 to 60. The ratio of methyl and methylene groups to ethylidene groups is 3–20:1, and the ethylidene groups are always separated by at least one methylene group. The weight average molecular weight of the polymethylalkanes of the present invention is 280–1,4000 g/mole, preferably 300–800 g/mole.

U.S. Pat. No. 5,376,745 (Handlin et al., Dec. 27, 1994) comprises linear unsaturated or hydrogenated isoprene polymers having number average molecular weights from 1,000 to 20,000, greater than 80% 1,4-addition of the isoprene, a polydispersity less than 2, and from about one to two terminal functional groups per molecule. Preferably, the isoprene polymers have number average molecular weights from 1,000 to 9,000, greater than 90% 1,4-addition of the isoprene, a polydispersity less than 1.5, and hydrogenation of at least 90% of the polymerized isoprene. The polymers are prepared by anionic polymerization in the absence of microstructure modifiers that increase 3,4-addition of the isoprene.

SUMMARY OF THE INVENTION

An oxidatively stable, biodegradable lubricant composition is disclosed which comprises (A) at least one hydrogenated polyisoprene prepared by polymerizing isoprene such that polyisoprene is obtained wherein there are from 4 to 1000 isoprene units and hydrogenating the polyisoprene to obtain a hydrogenated polyisoprene containing a residual olefinic unsaturation of not more than 10 percent based upon the unsaturation content prior to hydrogenation and;

(B) at least one performance additive selected from the group consisting of (1) an alkyl phenol of the formula

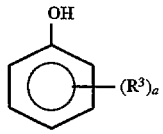

wherein $R^3$ is an alkyl group containing from 1 up to about 24 carbon atoms and a is an integer of from 1 up to 5;

(2) an ether of the formula

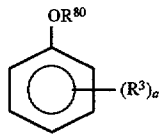

wherein $R^{80}$ is an alkyl group containing from one up to about 12 carbon atoms, $R^3$ is an alkyl group containing from one up to about 24 carbon atoms and a is an integer of from one up to 5; or

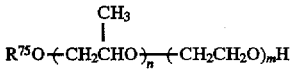

wherein $R^{75}$ is an aliphatic group containing from one up to 8 carbon atoms, n and m are independently integers of from zero up to 100 with the proviso that n and m are not both zero;

(3) a mixture of a mono- or di-substituted glyceride of the formula:

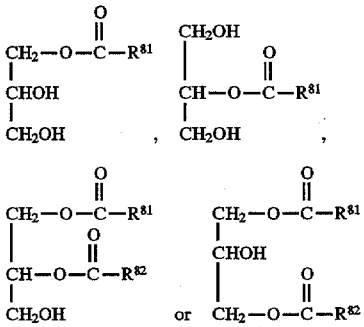

wherein $R^{81}$ and $R^{82}$ are hydrocarbyl independently containing from about 8 up to about 24 carbon atoms;

(4) a phosphorus-sulfur derivative of the formula

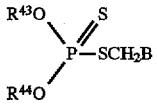

wherein $R^{43}$ and $R^{44}$ are independently hydrocarbyl groups containing from about 3 to about 20 carbon atoms and B is

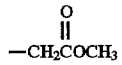

or a mixture of

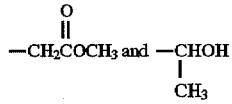

in a ketone:alcohol weight ratio of from 1:0.10–0.50;

(5) a benzotriazole of the formula

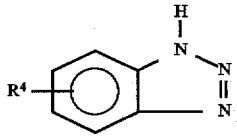

wherein $R^4$ is hydrogen or an alkyl group of 1 up to about 24 carbon atoms;

(6) a phosphorous amine salt;

(7) a trihydrocarbyl phosphorothionate;

(8) an aromatic amine of the formula

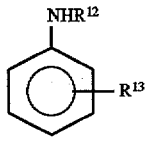

wherein $R^{12}$ is

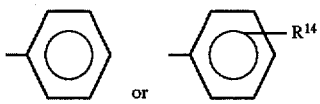

and $R^{13}$ and $R^{14}$ are independently a hydrogen or an alkyl group containing from 1 up to about 23 carbon atoms;

(9) a zinc salt of the formula

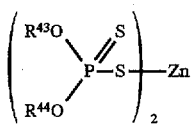

wherein $R^{43}$ and $R^{44}$ are independently hydrocarbyl groups containing from about 3 to 20 carbon atoms;

(10) an ester having pour point depressant properties characterized by low-temperature modifying properties of an ester of a carboxy-containing interpolymer, said interpolymer having a reduced specific viscosity of from about 0.05 to about 2 and being derived from at least two monomers, one of said monomers being a low molecular weight aliphatic olefin, styrene or a substituted styrene wherein the substituent is a hydrocarbyl group containing from 1 up to about 18 carbon atoms, and the other of said monomers being an alpha, beta-unsaturated aliphatic acid, anhydride or ester thereof, said ester being substantially free of titratable acidity and being characterized by the presence within its polymeric structure of pendant polar groups which are derived from the carboxy groups of said ester:

(a) a relatively high molecular weight carboxylic ester group, said carboxylic ester group having at least 8 aliphatic carbon atoms in the ester radical, optionally (b) a relatively low molecular weight carboxylic ester group having no more than 7 aliphatic carbon atoms in the ester radical, wherein the molar ratio of (a):(b) of the pour point depressant when (b) is present is (1–20):1, and optionally (c) a carbonyl-amino group derived from an amino compound having one primary or secondary amino group, wherein the molar ratio of (a):(b):(c) of the pour point depressant when (b) and (c) are present is (50–100):(5–50):(0.1–15);

(11) a hydrogenated block copolymer comprising a normal block copolymer or a random block copolymer, said normal block copolymer made from a vinyl substituted aromatic and an aliphatic conjugated diene, said normal block copolymer having from two to about five polymer blocks with at least one polymer block of said vinyl substituted aromatic and at least one polymer block of said aliphatic conjugated diene, said random block copolymer made from vinyl substituted aromatic and aliphatic conjugated diene monomers, the total amount of said vinyl substituted aromatic blocks in said block copolymer being in the range of from about 20 percent to about 70 percent by weight and the total amount of said diene blocks in said block copolymer being in the range of from about 30 percent to about 80 percent by weight; the number average molecular weight of said normal block copolymer and said random block copolymer being in the range of about 5,000 to about 1,000,000; and

(12) an acrylate polymer of the formula

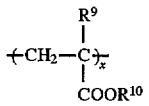

wherein $R^9$ is hydrogen or a lower alkyl group containing from 1 to about 4 carbon atoms, $R^{10}$ is a mixture of alkyl, cycloalkyl or aromatic groups containing from about 1 to about 24 carbon atoms and x is an integer providing a weight average molecular weight (Mw) to the acrylate polymer of about 5,000 to about 1,000,000.

DETAILED DESCRIPTION OF THE INVENTION

(A) The Hydrogenated Polyisoprene

Hydrogenated polyisoprenes are prepared from polyisoprenes. The polyisoprenes are polymers of isoprene and can be obtained or prepared either naturally or synthetically. The most common examples of polyisoprenes are natural rubber and terpenes. Isoprene itself is obtained mainly by extraction from hydrocarbon streams formed by cracking of naphtha or gas oil.

The polyisoprene prior to hydrogenating contains from 4 to 1,000 isoprene units and upon hydrogenating this polyisoprene, a hydrogenated polyisoprene is obtained wherein the residual olefinic unsaturation is not more than 10 percent based upon the unsaturation content prior to hydrogenation. Preferably this residual olefinic unsaturation is not more than 5 percent, and most preferably, not more than 1 percent.

Prior to hydrogenation, the polyisoprene has one of the following formulae:

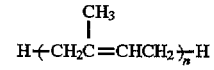

I or

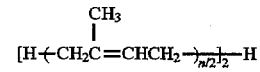

II wherein n is the number of isoprene units. The value of n is from 4 to 1,000 for either formula above. Preferably n is not more than 800. In one preferred embodiment utilizing formula I, n is from 200 to 600. In another preferred embodiment utilizing formula I, n is from 5 to 80. When utilizing formula II, preferably n is from 2 to 20 and most preferably n is 6 and formula II is squalene.

The formula I and formula II structures represent compounds containing monomeric units of isoprene linked together in a specific fashion. Within formula I, the isoprene units n are linked together in a "head to tail" fashion. When n is 6 in formula I, the following structure is obtained:

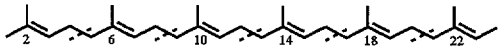

The broken line is at the junction point of the head to tail combination.

Within formula II, the isoprene units n/2 are also linked together in a "head to tail" fashion. However, when the two halves come together, they do so in a "tail to tail" fashion. When n is 6 in formula II, the following structure is obtained:

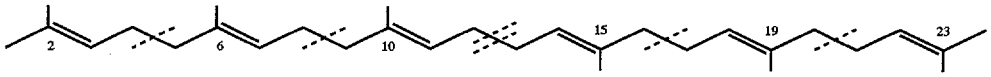

The single broken line is at the junction point of the head to tail combination and the double broken line is at the junction point of the tail to tail combination.

The synthesis of the following materials is relevant to the preparation of component (A) of this invention:

1. Synthesis of polyisoprene and its hydrogenation.
2. Direct synthesis of squalane.
3. Synthesis of squalene and its hydrogenation to squalane.

Synthesis of Polyisoprene and Its Hydrogenation

Depending on the catalyst and conditions, isoprene may undergo 1,2-, 3-4-or 1,4- addition polymerization leading to several isomeric structures. The below formulae shows the various modes of polymerization. Of particular interest in this invention are the 1,4 polymers.

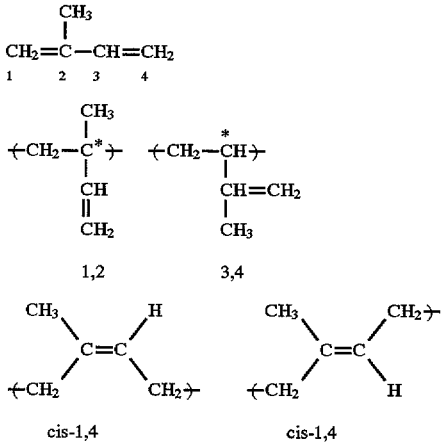

In the 1,2 and 3,4 additions, an asymmetric carbon atom is formed (marked by an asterisk) that has an R or S configuration. No optical activity is observed since equal numbers of R and S configurations are produced.

Several catalysts are important for the commercial polymerization of isoprene. For trans-1,4-polyisoprene, a coordination catalyst consisting of a vanadium salt and an alkylaluminum is utilized. For cis-1,4-polyisoprene, three catalyst systems are employed: alkyllithiums, a coordination catalyst consisting of titanium tetrachloride and an alane ($AlH_3$). Goodyear Tire and Rubber Company is currently the sole U.S. producer of cis-1,4-polyisoprene rubber.

Polymers of uniform chain length and predictable molecular weight are generally produced by the anionic-polymerization mechanism. The anionic mechanism is characterized by living, growing chains and control of the stereoismeric placement of the incoming monomer units. The phenomenal growth of anionic polymerization was spurred by the discovery that lithium metal and its organic compounds such as n-butyl lithium initiators are capable of polymerizing isoprene to a high (>90%) cis-1,4 microstructure as determined by IR analysis. This polyisoprene has almost the same chain structure as natural Hevea rubber. Furthermore, it was discovered that nonterminating chain addition is possible with vinyl polymers. This is generally governed by the following expression $$\text{Molecular weight of Polymer} = \frac{\text{Grams of Monomer}}{\text{Moles of Initiator}}$$

Sodium naphthalene solutions initiate the homogeneous anionic polymerization of isoprene and produce living polymers with chains that show no tendency to terminate growth as long as monomer is present.

Compared to propagation, the reaction between some organolithiums and isoprene in hydrocarbon solvents is slow, partly because of the strong association of these organolithiums in hydrocarbon solvents.

Kinetic studies on propagation show that the propagation reaction follows a first-order dependence on monomer concentration in hydrocarbon and ether solvents. For the alkyllithium polymerization of isoprene in ethers or amines, the propagation reaction exhibits first-order dependence on the concentration of growing chains (initiator change). The propagation kinetics of isoprene are rather complex. Studies on dienes in aliphatic and aromatic solvents show kinetic orders of between one fourth and one sixth.

The absence of spontaneous termination in many homogeneous anionic polymerizations allows the synthesis of polyisoprenes with very narrow molecular weight distributions when the initiation and propagation rates are of the same order of magnitude. Under these conditions, the molecular weight distribution approaches the Poisson distribution $$Pj = \frac{e^{-x}x^{j-1}}{(j-1)!}$$

where Pj is the number of fraction of j-mers and x is the number of monomers reached per initiator molecule.

To obtain predictable molecular weight and narrow molecular weight distribution from anionic polymerization, the following conditions are necessary. Terminating impurities such as moisture must be excluded. The initiation rate must be comparable to the propagation rate. The polymerization media must be homogeneous during both the initiation and propagation steps.

The anionic polymerization of isoprene can be carried out in the presence of N,N,N',N'-tetramethylethyleneidamine (TMEDA), increasing the polymerization rate and the 3,4-microstructural content of the resulting polymer; a plateau is reached for the ratio of TMEDA/living species =4 (about 70% 3,4 addition). In anionic polymerization of isoprene in cyclohexane by oligoisoprenyllithium complexed with TMEDA or pentamethyldiethylenetriamine (PMDT) the propagation rate can increase or decrease depending on the concentration range.

Isoprene does not polymerize readily under free-radical conditions in bulk or solution presumably due to the high mutual termination of growing radicals. However, emulsion polymerization at 50° C. with a potassium persulfate initiator gives a 75% conversion to polyisoprene in 15 hours with an [η] of 1.15 dL/g.

Isoprene readily undergoes cationic polymerization with conventional Lewis acids in chlorinated solvents at low temperature. At low conversion, low molecular weight products are obtained. At high conversion, the products are cross-linked, insoluble resins. The soluble products have mainly trans-1,4-microstructure and exhibit less than the theoretical unsaturation.

The stereoregularity of polyisoprene in bulk and in different hydrocarbon and polar solvents initiated by a constant, low concentration of n-butyllithium initiator at 25° C. has been studied. The concentration of alkyllithium initiator was kept constant to study the solvent effect on polyisoprene microstructure. The amounts of 3,4-and 1,4-microstructure are determined by $^1H$ nmr spectra, and the cis-1,4-and trans-1, 4-microstructures are determined from $^{13}C$ nmr spectra.

Hydrogenation of the polyisoprene may be carried out by treatment with hydrogen in the presence of a hydrogenation catalyst, usually at a temperature of about 50° C. to 350° C. for about 1 to 100 hours under a hydrogen pressure of about 5 to 300 kg/cm$^2$. The hydrogenation may be carried out in the presence or absence of an inert solvent such as alcohols (e.g. methanol, ethanol), ketones (e.g. acetone, methylethylketone), aliphatic hydrocarbons (e.g. heptane, hexane, pentane, cyclohexane) or their mixtures. As the hydrocarbon catalyst, there may be used any conventional one such as nickel (e.g. Raney nickel, nickel on diatomaceous earth, Urushibara nickel, palladium and platinum. After completion of the hydrogenation, the catalyst and the solvent are removed from the reaction mixture by usual methods, and the distillation of the reaction mixture under reduced pressure affords the hydrogenated product of liquid polymer.

EXAMPLE A-1

The atmosphere in a 1.5 stainless steel autoclave (20 kg/cm$^2$ proof) equipped with a stirrer was replaced by nitrogen gas. Thereafter, 300 ml of anhydrous toluene and 136 g of anhydrous isoprene were charged into the autoclave under the stream of nitrogen. The mixture was cooled to −50° C., and 4 ml of a toluene solution containing 0.1 mol/liter of nickel naphthenate, 4 ml of a toluene solution containing 1 mol/liter of ethylaluminum sesquichloride, 4 ml of a toluene solution containing 0.02 mol/liter of triphenyl phosphine and 64 g of propylene were added thereto, followed by polymerization at 60° C. for 6 hours. The polymerization was stopped by adding 10 ml of a 10% solution of isopropanol in toluene under pressure, followed by stirring for 10 minutes. Unreacted propylene and isoprene were purged in a draft, and the reaction mixture was washed for 5 hours with 800 ml of an aqueous hydrochloric acid solution (pH 1.6) in a 2-liter glass flask and allowed to stand. The aqueous layer was removed, and the oily layer was mixed with 800 ml of an aqueous sodium hydroxide solution (pH 12) for 1 hour and allowed to stand. The aqueous layer was removed, and the oily layer was thoroughly mixed with 800 ml of ion-exchanged water for 1 hour and allowed to stand. The aqueous layer was removed, and the oily layer was concentrated under reduced pressure in a rotary, evaporator. In this way, 103 g of low molecular weight polyisoprene were obtained as a colorless, transparent liquor having a viscosity of 24 cp at 30° C. The number average molecular weight was 410 on determining by means of a vapor pressure osmometer. The infrared analysis showed that the microstructure of the polymer consisted of 42% of the cis-1,4 structure, 35.2% of the trans-1,4 structure, 19.8% of the 3,4 structure and 2.7% of the 1,2 structure. Further, it was confirmed that the value of the 3,4 structure was due to the absorption of the vinylidene group which resulted from the dehydrogenation of one propylene molecule connected to the ends of the polymer chains. Thus, more than 90% of isoprene was polymerized in the 1,4-polymerization form.

Raney nickel R-200 (produced by Nikko Rikagaku Sangyo Co. , Ltd.) was activated, followed by deaeration and dehydration, and stored in a Schlenk's tube replaced by nitrogen gas. To a 200-ml stainless steel autoclave were added 5 g of the Raney nickel, 75 ml of the above obtained liquid polyisoprene and 75 ml of cyclohexane, and hydrogen gas was charged therein from a hydrogen bomb until a pressure gauge indicated 25 kg/cm$^2$. The contents were heated to 150° C. in an oil bath while being mixed. Mixing was further continued at 150° C. under 25 kg/cm$^2$ for 30 hours so as to complete the hydrogenation. After cooling, the pressure in the autoclave was released to attain atmospheric pressure, and the catalyst was removed centrifugally to obtain a colorless, transparent liquor. The liquor was concentrated under reduced pressure in a rotary evaporator to remove the solvent, whereby 74 ml of a colorless, transparent liquor having viscosity of 35 cps at 30° C. were obtained.

EXAMPLE A-2

The atmosphere in a 1.5-liter stainless steel autoclave (20 kg/cm$^2$ proof) equipped with a stirrer was replaced by nitrogen gas. Thereafter, 300 ml of anhydrous toluene and 136 g of anhydrous isoprene were charged into the autoclave under the stream of nitrogen. The mixture was cooled to −50° C., and 4 ml of a toluene solution containing 0.1 mol/liter of nickel naphthenate, 4 ml of a toluene solution containing 1 mol/liter of ethylaluminum sesquichloride, 20 ml of a toluene solution containing 0.02 mol/liter of triphenyl phosphine and 64 g of propylene were added thereto, followed by polymerization at 60° C. for 6 hours. The polymerization was stopped in the same manner as in Example A-1. Removal of the catalyst was also carried out in the same manner as in Example A-1, followed by concentration under reduced pressure in a rotary evaporator. In this way, 73 g of low molecular weight polyisoprene were obtained as a colorless, transparent liquor having a viscosity of 983 cps at 30° C. The number average molecular weight was 540 on determining by means of a vapor pressure osmometer. The infrared analysis showed that the microstructure of the polymer consisted of 43.6% of the cis-1,4 structure, 36.9% of the trans-1.4 structure, 19.0% of the 3,4 structure and 0.5% of the vinyl structure. Further, it was confirmed that the 3,4 structure was due to the absorption of the vinylidene group which resulted from the dehydrogenation of one propylene molecule connected to the ends of the polymer chains.

Hydrogenation was carried out by replacing the atmosphere in a 200-ml stainless steel autoclave by nitrogen gas, charging 65 ml of the above obtained liquid polyisoprene, 5 g of Raney nickel R-200 as activated and 75 ml of cyclohexane in the autoclave, and mixing the contents at 150° C. for 30 hours while maintaining the hydrogen pressure in the autoclave at 25 kg/cm$^2$. After cooling, the catalyst was centrifugally removed to obtain a colorless, transparent liquor. The liquor was concentrated under reduced pressure in a rotary evaporator to remove the solvent, whereby 64 ml of a colorless, transparent liquor having a viscosity of 1,050 cps at 30° C. were obtained. The iodine value, the hydroxyl value and the acid value were all zero.

EXAMPLE A-3

A rotator for a magnetic stirrer was placed in a 500-ml four-necked flask, and the mouths of the flask were equipped with ampoules containing 28.2 g of anhydrous naphthalene, 200 ml of anhydrous tetrahydrofuran, 40 ml of anhydrous isoprene and 1.38 g of metallic lithium, respectively. After completely replacing the atmosphere in the flask by nitrogen gas, the ampoule containing metallic lithium was opened by a magnetic hammer to allow the lithium to fall into the flask. Next, tetrahydrofuran and naphthalene were allowed to fall into the same manner as above. On mixing the contents in the flask at room temperature for 17 hours, a deep green complex of lithium-naphthalene was formed. After cooling to −70° C., isoprene was added, and the mixture was stirred at room temperature for 2 hours, whereby the reaction solution turned to yellow brown. The tetrahydrofuran was removed from the reaction solution under reduced pressure, and then 100 ml of anhydrous n-hexane and 100 ml of cyclohexane were added thereto under the stream of nitrogen gas. After cooling to −40° C., 95 ml of isoprene were added, and polymerization was carried out at 50° C. for 3 hours. The metallic lithium was removed from the product, in the same manner as in Example A-1, by washing the reaction mixture with an aqueous hydrochloric acid solution. After neutralization and washing with water, the separated oil layer was concentrated under reduced pressure in a rotary evaporator to give low molecular weight polyisoprene. The microstructure of the resulting polymer was found to consist of 85% of the cis-1,4 structure and 15% of the 3,4 structure. The molecular weight determined by means of a vapor pressure osmometer was 760.

In the same manner as in Example A-1, 64 g of the polyisoprene was hydrogenated in a 200-ml stainless steel autoclave using 5 g of Raney nickel R-200 and 75 ml of cyclohexane. The hydrogenation was carried out at 150° C. for 30 hours with stirring, while keeping the hydrogen pressure in the autoclave at 30 kg/cm$^2$. After cooling, the catalyst was centrifugally removed to obtain a colorless, transparent liquor. The liquor was concentrated under reduced pressure in a rotary evaporator to obtain 63 g of a colorless and odorless, transparent liquor having a viscosity of 130 cp at 30° C.. The iodine value, the hydroxyl value and the acid value of the liquor were all zero.

EXAMPLE A-4

Preparation of the catalyst, the polymerization and the after-treatment was carried out in the same manner as in Example A-3 using 7.05 g of anhydrous naphthalene, 200 ml of anhydrous tetrahydrofuran, 25 ml of anhydrous isoprene and 0.345 g of metallic lithium to give low molecular weight polyisoprene. The microstructure of the obtained polymer was found to consist of 88% of the cis-1,4 structure and 12% of the 3,4 structure. The molecular weight determined by means of a vapor pressure osmometer was 2,800.

In the same manner as in Example A-1, 64 g of the liquid polyisoprene was hydrogenated at 150° C. for 30 hours using 5 g of Raney nickel R-200 and 75 ml of cyclohexane while keeping the hydrogen pressure at 30 kg/cm$^2$. After cooling, the reaction mixture was centrifuged in order to remove the catalyst, and concentrated under reduced pressure in a rotary evaporator to obtain 63 g of a colorless, transparent liquor. The liquor was colorless and odorless and had a viscosity of 3,600 cp. The iodine value, the hydroxyl value and the acid value of the liquor were all zero.

The above examples are directed to the polymerization and hydrogenation of a compound of formula I wherein n is from 6 to 41. A hydrogenated material satisfying formula I wherein n is from 200 to 600 is available from Kurarau Isoprene Co., Ltd., Tokyo, Japan marketed as LIR-290. This is a liquid polyisoprene which has been hydrogenated to saturate 90 percent of its original double bonds. Kurarau LIR-290 has a molecular weight of about 25,000 and an n of about 358.

Direct Synthesis of Squalane

Squalane can be synthesized by two methods using an acetylenic carbinol as presented in a paper by J. W. Scott and D. Valentine, Jr. in Organic Preparation and Procedures Int., 1980, 12, 7–11. An acetylenic carbinol is prepared from a methyl ketone. The carbinol is oxidatively dimerized either to a dieyne (III) or to an eneyne (IV). Squalane is generated when either (III) or (IV) are hydrogenated.

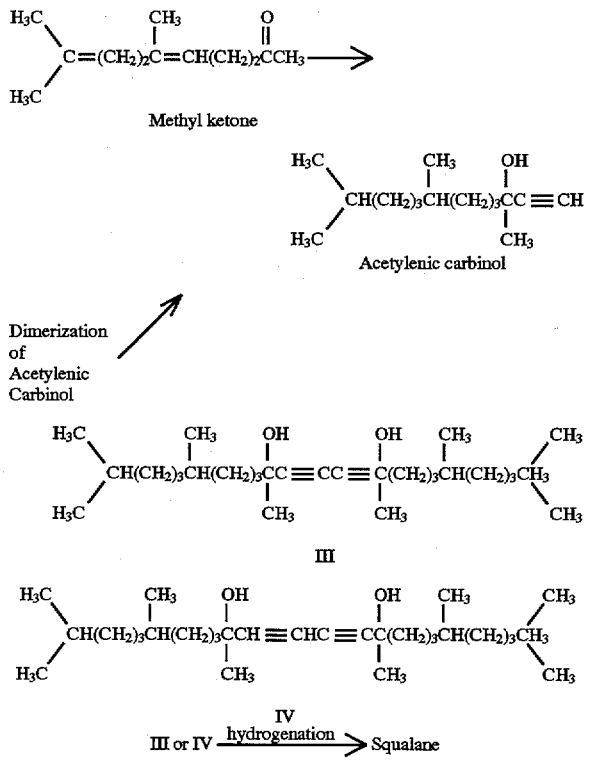

Synthesis of Squalene and Its Hydrogenation to Squalane

Squalene can be synthesized by a Barbier reaction between geranylacetone and tetramethlene dibromide in the presence of magnesium as presented in a paper by Dauben, W. G., J. Amer. Chem. Soc., 1952, 74, 5204.

(B) The Performance Additive

The compositions of this invention include a performance additive (B). The performance enhanced by these additives are in the area of antiwear, oxidation inhibition, rust/corrosion inhibition, metal passivation, extreme pressure, friction modification, foam inhibition, emulsification, lubricity and the like.

The performance additive (B) comprises at least one (1) phenol, (2) ether, (3) mono- or di- glyceride, (4) phosphorus-sulfur derivative, (5) benzotriazole, (6) phosphorus amine salt, (7) trihydrocarbyl phosphorothionate, (8) aromatic amine, (9) zinc salt,

(10) pour point depressant ester,

(11) hydrogenated block copolymer, or

(12) acrylate polymer.

(B1) The Phenol

Component (B1) is an alkyl phenol of the formula

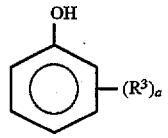

wherein $R^3$ is an alkyl group containing from 1 up t about 24 carbon atoms and a is an integer of from 1 up to 5. Preferably $R^3$ contains from 4 to 18 carbon atoms and most preferably from 4 to 12 carbon atoms. $R^3$ may be either straight chained or branched chained and branched chained is preferred. The preferred value for a is an integer of from 1 to 4 and most preferred is from 1 to 3. An especially preferred value for a is 2. When a is not 5, it is preferred that the position para to the OH group be open.

Mixtures of alkyl phenols may be employed. Preferably the phenol is a butyl substituted phenol containing 2 or 3 t-butyl groups. When a is 2, the t-butyl groups occupy the 2,6-position, that is, the phenol is sterically hindered:

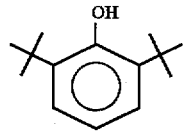

When a is 3, the t-butyl groups occupy the 2,4,6 position.

(B2) The Ether

The ether is of the formula

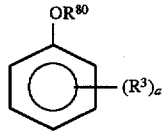

wherein $R^{80}$ is an alkyl group containing from one up to about 12 carbon atoms, $R^3$ is an alkyl group containing from one up to about 24 carbon atoms and a is an integer of from one up to 5. Preferably $R^{80}$ contains from one to 8 carbon atoms and most preferably $R^{80}$ contains from one to 4 carbon atoms. The $R^3$ group preferably contains from 6 to 18 carbon atoms and most preferably from 8 to 12 carbon atoms. The integer a is preferably 1 or 2.

Another ether having utility as (B2) is an alkoxylated ether of the formula

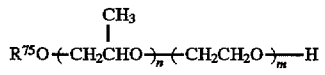

wherein $R^{75}$ is an aliphatic group containing from one up to 8 carbon atoms, n and m are independently integers of from zero to 100, with the proviso that n and m are not both zero. Preferably $R^{75}$ is a butyl group.

Alkyoxylated ethers are available commercially as UCON Fluids from the Lubricants Division of Union Carbide, South Charleston, W. Va. Specific examples include UCON® LB-385, LB-625, LB-1145, LB-1715 and LB-3000 fluids. In the LB series, m is zero. Also of utility are UCON® 50-HB-660, 50-HB-2000, 50-HB-2520, and 50-HB-5100 fluids. In the 50-HB series n=m.

(B3) The Mono- or Di- Substituted Glyceride

Mono- or di- substituted glycerides are of the formulae

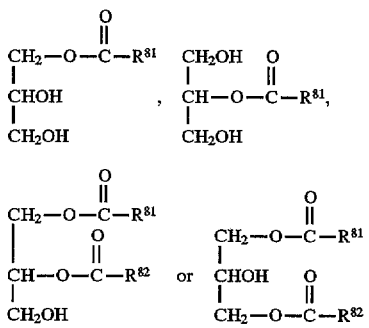

wherein $R^{81}$ and $R^{82}$ are hydrocarbyl groups independently containing from about 8 up to about 24 carbon atoms. Preferably $R^{81}$ and $R^{82}$ are aliphatic groups that contain from 12 to 18 carbon atoms and most preferably from 16 to 18 carbon atoms. When component (B3) is employed, it is present as a mixture of the above formulae.

(B4) The Phosphorus-Sulfur Derivative

The phosphorus-sulfur derivative has the formula

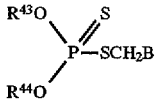

wherein $R^{43}$ and $R^{44}$ are independently hydrocarbyl groups containing from about 3 to about 20 carbon atoms and B is

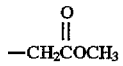

or a mixture of

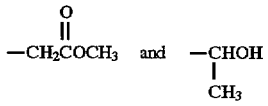

in a ketone:alcohol weight ratio of from 1:0.10–0.50;

An 0,0-dihydrocarbyl phosphorodithioic acid of the formula

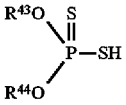

is prepared by reacting an alcohol or phenol with phosphorus pentasulfide ($P_2S_5$). The reaction involves mixing at a temperature of about 20° C. to about 200° C., four moles of an alcohol or phenol with one mole of phosphorus pentasulfide. Hydrogen sulfide is liberated in this reaction. The acid is then reacted with methyl acrylate or in those instances where there is free phosphorodithioic acid remaining after the addition of methyl acrylate, the free phosphorodithioic acid is reacted with propylene oxide. The reaction scheme is as follows:

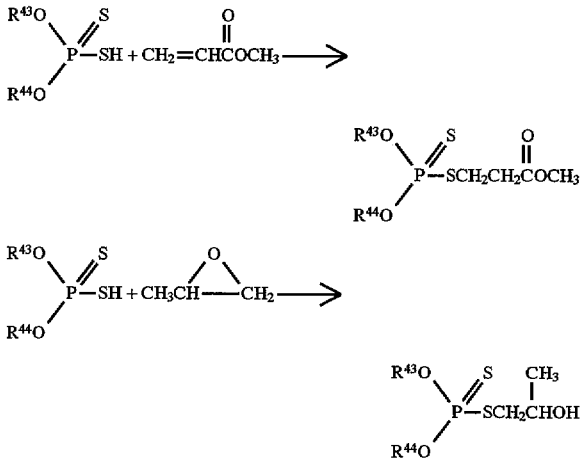

EXAMPLE (B4)-1

A reaction vessel is charged with 3216 parts of a mixture of 26 moles of isobutyl alcohol and 14 moles of mixed primary amyl alcohols (65% w n-amyl and 35% w 2-methyl-1-butanol). Phosphorus pentasulfide (2220 parts, 10 moles) is added to the vessel while maintaining the reaction temperature between about 104°–107° C. After all of the phosphorus pentasulfide is added, the mixture is heated for an additional period of time to insure completion of the reaction and filtered. The filtrate is the desired phosphorodithioic acid which contains about 11.2% phosphorus and 22% sulfur and has a direct acid number of 190.

To another reaction vessel is added 1000 parts (3.39 equivalents) of the above phosphorodithioic acid and the contents are heated to 63° C. over 2 hours while blowing with nitrogen. Then added is 292 parts (3.39 equivalents) of methyl acrylate. The addition is exothermic and the temperature is maintained at 60°–80° C. The temperature is then increased to 95°–100° C. and held there for 4 hours. At 40° C. 25.7 parts (0.44 equivalents) of propylene oxide is added below the surface in 0.75 hours. The batch is then heated to 50° C. and filtered to give a product with 8.8% phosphorus and 17.5% sulfur.

(B5) The Benzotriazole

The benzotriazole compound is of the formula

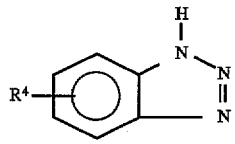

wherein $R^4$ is hydrogen a straight or branched-chain alkyl group containing from up to about 24 carbon atoms, preferably 1 to 12 carbon atoms and most preferably 1 carbon atom. When $R^4$ is 1 carbon atom the benzotriazole compound is tolytriazole of the formula

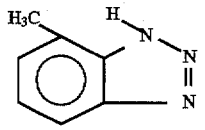

Tolytriazole is available under the trade name Cobratec TT-100 from Sherwin-Williams Chemical. Other benzotriazoles available are Reomet 39® available from Ciba-Geigy.

(B6) The Phosphorus Amine Salt

Another performance additive is a phosphorus amine salt of the formula

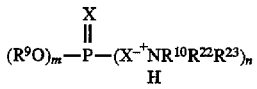

where $R^9$ and $R^{10}$ are independently aliphatic groups containing from about 4 up to about 24 carbon atoms, $R^{22}$ and $R^{23}$ are independently hydrogen or aliphatic groups containing from about 1 up to about 18 aliphatic carbon atoms, the sum of m and n is 3 and X is oxygen or sulfur. In a preferred embodiment, $R^9$ contains from about 8 up to 18 carbon atoms, $R^{10}$ is

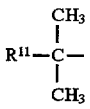

wherein $^{11}$ is an aliphatic group containing from about 6 up to about 12 carbon atoms, $R^{22}$ and $R^{23}$ are hydrogen, m is 2, n is 1 and X is oxygen. In a most preferred embodiment, component (C) is Irgalube® 349 which is commercially available from Ciba-Geigy.

(B7) The Trihydrocarbyl Phosphorothionate

The trihydrocarbyl phosphorothionate is the formula

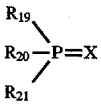

wherein $R^{19}$, $R^{20}$ and $R^{21}$ are independently hydrogen, an aliphatic or alkoxy group containing from 1 up to 12 carbon atoms, or an aryl or aryloxy group wherein the aryl group is phenyl or naphthyl and the aryloxy group is phenoxy or naphthoxy and X is oxygen or sulfur. The most preferred trihydrocarbyl phosphorothionate is available from Ciba-Geigy under the name Irgalube® TPPT. The structure of TPPT is

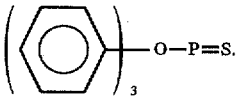

(B8) The Aromatic Amine

Component (B8) is an aromatic amine of the formula

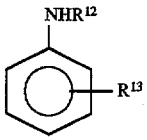

wherein $R^{12}$ is

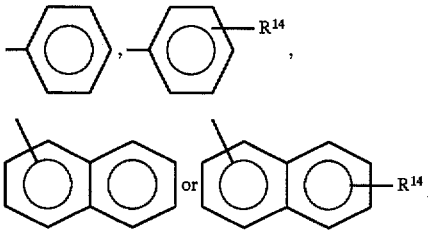

and $R^{13}$ and $R^{14}$ are independently a hydrogen or an alkyl group containing from 1 up to 24 carbon atoms. Preferably $R^{12}$ is

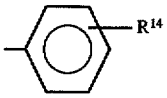

and $R^{13}$ and $R^{14}$ are alkyl groups containing from 4 up to about 18 carbon atoms. In a particularly advantageous embodiment, component (B8) comprises an alkylated diphenylamine such as nonylated diphenylamine of the formula

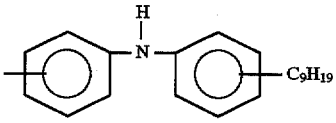

(B9) The Zinc Salt

A zinc salt of the formula

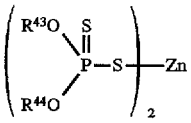

wherein $R^{43}$ and $R^{44}$ are independently hydrocarbyl groups containing from about 3 to about 20 carbon atoms are readily obtainable by the reaction of phosphorus pentasulfide ($P_2S_5$) and an alcohol or phenol to form an 0,0-dihydrocarbyl phosphorodithioic acid corresponding to the formula

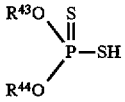

The reaction involves mixing at a temperature of about 20° C. to about 200° C., four moles of an alcohol or a phenol with one mole of phosphorus pentasulfide. Hydrogen sulfide is liberated in this reaction. The acid is then reacted with zinc oxide to form the zinc salt.

The $R^{43}$ and $R^{44}$ groups are independently hydrocarbyl groups that are preferably free from acetylenic and usually also from ethylenic unsaturation and have from about 3 to about 20 carbon atoms, preferably 3 to about 16 carbon atoms and most preferably 3 to about 12 carbon atoms.

EXAMPLE (B9)-1

A reaction vessel is charged with 448 parts of zinc oxide (11 equivalents) and 467 parts of the alcohol mixture from Example (B4)-1. The phosphorodithioic acid (3030 parts, 10.5 equivalents) from Example (B4)-1 is added at a rate to maintain the reaction temperature at about 45° C.–50° C. The addition is completed in 3.5 hours whereupon the temperature of the mixture is raised to 75° C. for 45 minutes. After cooling to about 50° C., an additional 61 parts of zinc oxide (1.5 equivalents) are added, and this mixture is heated to 75° C. for 2.5 hours. After cooling to ambient temperature, the mixture is stripped to 124° C. at 12 mm. pressure. The residue is filtered twice through diatomaceous earth, and the filtrate is the desired zinc salt containing 22.2% sulfur (theory, 22.0), 10.4% phosphorus (theory, 10.6) and 10.6% zinc (theory, 11.1)

EXAMPLE (B9)-2

The procedure of Example (B9)-1 is essentially followed except that 2-methylpentyl alcohol is used in place of the isobutyl alcohol and amyl alcohols. The product obtained has 8.5% phosphorus, 17.6% sulfur and 9.25% zinc.

(10) The Pour Point Depressant Ester

Pour point depressant (PPD) esters having utility in this invention are carboxy containing interpolymers in which many of the carboxy groups are esterified and the remaining carboxy groups, if any, are neutralized by reaction with amino compounds.

This PPD is an ester of a carboxy-containing interpolymer, said interpolymer having a reduced specific viscosity of from about 0.05 to about 2, and being derived from at least two monomers, one of said monomers being a low molecular weight aliphatic olefin, styrene or substituted styrene wherein the substituent is a hydrocarbyl group containing from 1 up to about 18 carbon atoms, and the other of said monomers being an alpha, beta-unsaturated aliphatic acid, anhydride or ester thereof, said ester being substantially free of titratable acidity, i.e., at least 90% esterification, and being characterized by the presence within its polymeric structure of pendant polar groups which are derived from the carboxy group of acid ester: (a) a relatively high molecular weight carboxylic ester group having at least 8 aliphatic carbon atoms in the ester radical, optionally (b) a relatively low molecular weight carboxylic ester group having no more than 7 aliphatic carbon atoms in the ester radical, and optionally (c) a carbonyl-polyamino group derived from a polyamino compound having one primary or secondary amino group, wherein the molar ratio of (a):(b) is (1–20): 1, preferably (1–10):1 and wherein the molar ratio of (a):(b):(c) is (50–100):(5–50):(0.1–15)

In reference to the size of the ester groups, it is pointed out that an ester radical is represented by the formula

—C(O)(OR)

and that the number of carbon atoms in an ester radical is the combined total of the carbon atoms of the carbonyl group and the carbon atoms of the ester group i.e., the (OR) group.

An optional element of this ester is the presence of a polyamino group derived from a particular amino compound, i.e., one in which there is one primary or secondary amino group and at least one mono-functional amino group. Such polyamino groups, when present in this mixed ester in the proportion stated above enhances the dispensability of such esters in lubricant compositions and additive concentrates for lubricant compositions.

Still another essential element of the mixed ester is the extent of esterification in relation to the extent of neutralization of the unesterified carboxy groups of the carboxy-containing interpolymer through the conversion thereof to the optional polyamino-containing groups. For convenience, the relative proportions of the high molecular weight ester group to the low molecular weight ester group and to the polyamino group when these latter two components are utilized are expressed in terms of molar ratios of (50–100):(5–50):(0.1–15), respectively. The preferred ratio is (70–85):(15–30):(3–4). It should be noted that the linkage described as the carbonyl-polyamino group may be imide, amide, or amidine and inasmuch as any such linkage is contemplated within the present invention, the term "carbonyl polyamino" is thought to be a convenient, genetic expression useful for the purpose of defining the inventive concept. In a particularly advantageous embodiment of the invention such linkage is imide or predominantly imide.

Still another important element of the mixed ester is the molecular weight of the carboxy-containing interpolymer. For convenience, the molecular weight is expressed in terms of the "reduced specific viscosity" of the interpolymer which is a widely recognized means of expressing the molecular size of a polymeric substance. As used herein, the reduced specific viscosity (abbreviated as RSV) is the value obtained in accordance with the formula $$RSV = \frac{\text{Relative Viscosity} - 1}{\text{Concentration}}$$

wherein the relative viscosity is determined by measuring, by means of a dilution viscometer, the viscosity of a solution of one gram of the interpolymer in 10 ml. of acetone and the viscosity of acetone at 30°±0.02° C. For purpose of computation by the above formula, the concentration is adjusted to 0.4 gram of the interpolymer per 100 ml. of acetone. A more detailed discussion of the reduced specific viscosity, also known as the specific viscosity, as well as its relationship to the average molecular weight of an interpolymer, appears in Paul J. Flory, *Principles of Polymer Chemistry*., (1953 Edition) pages 308 et seq.

While interpolymers having reduced specific viscosity of from about 0.05 to about 2 are contemplated in the mixed ester, the preferred interpolymers are those having a reduced specific viscosity of from about 0.1 to about 1. In most instances, interpolymers having a reduced specific viscosity of from about 0.1 to about 0.8 are particularly preferred.

From the standpoint of utility, as well as for commercial and economical reasons, esters in which the high molecular weight ester group has from 8 to 24 aliphatic carbon atoms, the low molecular weight ester group has from 3 to 5 carbon atoms, and the carbonyl amino group is derived from a primary-aminoalkyl-substituted tertiary amine, particularly heterocyclic amines, are preferred. Specific examples of the high molecular weight carboxylic ester group, i.e., the (OR) group of the ester radical (i.e., —(O)(OR)) include heptyloxy, isooctyloxy, decyloxy, dodecyloxy, tridecyloxy, tetradecyloxy, pentadecyloxy, octadecyloxy, eicosyloxy, tricosyloxy, tetracosyloxy, etc. Specific examples of low molecular weight groups include methoxy, ethoxy, n-propyloxy, isopropyloxy, n-butyloxy, sec-butyloxy, isobutyloxy, n-pentyloxy, neo-pentyloxy, n-hexyloxy, cyclohexyloxy, xyxlopentyloxy, 2-methyl-butyl-1-oxy, 2,3-dimethyl-butyl-1-oxy, etc. In most instances, alkoxy groups of suitable size comprise the preferred high and low molecular weight ester groups. Polar substituents may be present in such ester groups. Examples of polar substituents are chloro, bromo, ether, nitro, etc.

Examples of the carbonyl polyamino group include those derived from polyamino compounds having one primary or secondary amino group and at least one mono-functional amino group such as tertiary-amino or heterocyclic amino group. Such compounds may thus be tertiary-amino substituted primary or secondary amines or other substituted primary or secondary amines in which the substituent is derived from pyrroles, pyrrolidones, caprolactams, oxazolidones, oxazoles, thiazoles, pyrazoles, pyrazolines, imidazoles, imidazolines, thiazines, oxazines, diazines, oxycarbamyl, thiocarbamyl, uracils, hydantoins, thiohydantoins, guanidines, ureas, sulfonamides, phosphoramides, phenothiaznes, amidines, etc. Examples of such polyamino compounds include dimethylamino-ethylamine, dibutylamino-ethylamine, 3-dimethylamino-1-propylamine, 4-methylethylamino-1-butylamine, pyridyl-ethylamine, N-morpholino-ethylamine, tetrahydropyridylethylamine, bis-(dimethylamino)propyl-amine, bis-(diethylamino)ethylamine, N,N-dimethyl-p-phenylene diamine, piperidyl-ethylamine, 1-aminoethyl pyrazole, 1-(methylamino)pyrazoline, 1-methyl-4-amino-octyl pyrazole, 1-aminobutyl imidazole, 4-aminoethyl thiazole, 2-aminoethyl pyridine, ortho-amino-ethyl-N,N-dimethylbenzenesulfamide, N-aminoethyl phenothiazine, N-aminoethylacetamidine, 1-aminophenyl-2-aminoethyl pyridine, N-methyl-N-aminoethyl-S-ethyl-dithiocarbamate, etc. Preferred polyamino compounds include the N-aminoalkyl-substituted morpholines such as aminopropyl morpholine. For the most part, the polyamino compounds are those which contain only one primary-amino or secondary-amino group and, preferably at least one tertiary-amino group. The tertiary amino group is preferably a heterocyclic amino group. In some instances polyamino compounds may contain up to about 6 amino groups although, in most instances, they contain one primary amino group and either one or two tertiary amino groups. The polyamino compounds may be aromatic or aliphatic amines and are preferably heterocyclic amines such as amino-alkyl-substituted morpholines, piperazines, pyridines, benzopyrroles, quinolines, pyrroles, etc. They are usually amines having from 4 to about 30 carbon atoms, preferably from 4 to about 12 carbon atoms. Polar substituents may likewise be present in the polyamines.

The carboxy-containing interpolymers include principally interpolymers of alpha, beta-unsaturated acids or anhydrides such as maleic anhydride or itaconic anhydride with olefins (aromatic or aliphatic) such as ethylene, propylene, isobutene or styrene, or substituted styrene wherein the substituent is a hydrocarbyl group containing from 1 up to about 18 carbon atoms. The styrene-maleic anhydride interpolymers are especially useful. They are obtained by polymerizing equal molar amounts of styrene and maleic anhydride, with or without one or more additional interpolymerizable comonomers. In lieu of styrene, an aliphatic olefin may be used, such as ethylene, propylene or isobutene. In lieu of maleic anhydride, acrylic acid or methacrylic acid or ester thereof may be used. Such interpolymers are know in the art and need not be described in detail here. Where an interpolymerizable comonomer is contemplated, it should be present in a relatively minor proportion, i.e., less that about 0.3 mole, usually less than about 0.15 mole, per mole of either the olefin (e.g. styrene) or the alpha, beta-unsaturated acid or anhydride (e.g. maleic anhydride). Various methods of interpolymerizing styrene and maleic anhydride are known in the art and need not be discussed in detail here. For purpose of illustration, the interpolymerizable comonomers include the vinyl monomers such as vinyl acetate, acrylonitrile, methylacrylate, methylmethacrylate, acrylic acid, vinyl methyl either, vinyl ethyl ether, vinyl chloride, isobutene or the like.

The nitrogen-containing esters of the mixed ester are most conveniently prepared by first 100 percent esterifying the carboxy-containing interpolymer with a relatively high molecular weight alcohol and a relatively low molecular weight alcohol. When the optional (c) is employed, the high molecular weight alcohol and low molecular weight alcohol are utilized to convert at least about 50% and no more than about 98% of the carboxy radicals of the interpolymer to ester radicals and then neutralizing the remaining carboxy radicals with a polyamino compound such as described above. To incorporate the appropriate amounts of the two alcohol groups into the interpolymer, the ratio of the high molecular weight alcohol to the low molecular weight alcohol used in the process should be within the range of from about 2:1 to about 9:1 on a molar basis. In most instances the ratio is from about 2.5:1 to about 5: 1. More than one high molecular weight alcohol or low molecular weight alcohol may be used in the process; so also may be used commercial alcohol mixtures such as the so-called Oxoalcohols which comprise, for example mixtures of alcohols having from 8 to about 24 carbon atoms. A particularly useful class of alcohols are the commercial alcohols or alcohol mixtures comprising decylalcohol, dodecyl alcohol, tridecyl alcohol, tetradecyl alcohol, pentadecyl alcohol, hexadecyl alcohol, heptadecyl alcohol and octadecyl alcohol. Other alcohols useful in the process are illustrated by those which, upon esterification, yield the ester groups exemplified above.

The extent of esterification, as indicated previously, may range from about 50% to about 98% conversion of the carboxy radicals of the interpolymer to ester radicals. In a preferred embodiment, the degree of esterification ranges from about 75% to about 95%.

The esterification can be accomplished simply be heating the carboxy-containing interpolymer and the alcohol or alcohols under conditions typical for effecting esterification. Such conditions usually include, for example, a temperature of at least about 80° C., preferably from about 150° C. to about 350° C., provided that the temperature be below the decomposition point of the reaction mixture, and the removal of water of esterification as the reaction proceeds. Such conditions may optionally include the use of an excess of the alcohol reactant so as to facilitate esterification, the use of a solvent or diluent such as mineral oil, toluene, benzene, xylene or the like and a esterification catalyst such as toluene sulfonic acid, sulfuric acid, aluminum chloride, boron trifluoride-triethylamine, hydrochloric acid, ammonium sulfate, phosphoric acid, sodium methoxide or the like. These conditions and variations thereof are well know in the art.

A particularly desirable method of effecting esterification involves first reacting the carboxy-containing interpolymer with the relatively high molecular weight alcohol and then reacting the partially esterified interpolymer with the relatively low molecular weight alcohol. A variation of this technique involves initiating the esterification with the relatively high molecular weight alcohol and before such esterification is complete, the relatively low molecular weight alcohol is introduced into the reaction mass so as to achieve a mixed esterification. In either event it has been discovered that a two-step esterification process whereby the carboxy-containing interpolymer is first esterified with the relatively high molecular weight alcohol so as to convert from about 50% to about 75% of the carboxy radicals to ester radicals and then with the relatively low molecular weight alcohol to achieve the finally desired degree of esterification results in products which have unusually beneficial viscosity properties.

The esterified interpolymer may optionally be treated with a polyamino compound in an amount so as to neutralize substantially all of the unesterified carboxy radicals of the interpolymer. The neutralization is preferably carried out at a temperature of at least about 80° C., often from about 120° C. to about 300° C., provided that the temperature does not exceed the decomposition point of the reaction mass. In most instances the neutralization temperature is between about 150° C. and 250° C.. A slight excess of the stoichiometric amount of the amino compound is often desirable, so as to insure substantial completion of neutralization, i.e., no more than about 2% of the carboxy radicals initially present in the interpolymer remained unneutralized.

The following examples are illustrative of the preparation of the mixed ester of the present invention. Unless otherwise indicated all parts and percentages are by weight.

EXAMPLE (B10)-1

A styrene-maleic interpolymer is obtained by preparing a solution of styrene (16.3 parts by weight) and maleic anhydride (12.9 parts) in a benzene-toluene solution (270 parts; weight ratio of benzene:toluene being 66.5:33.5) and contacting the solution at 86° C. in nitrogen atmosphere for 8 hours with a catalyst solution prepared by dissolving 70% benzoyl peroxide (0.42 part) in a similar benzene-toluene mixture (2.7 parts). The resulting product is a thick slurry of the interpolymer in the solvent mixture. To the slurry there is added mineral oil (141 parts) while the solvent mixture is being distilled off at 150° C. and then at 150° C./200 mm. Hg. To 209 parts of the stripped mineral oil-interpolymer slurry (the interpolymer having a reduced specific viscosity of 0.72) there are added toluene (25.2 parts), n-butyl alcohol (4.8 parts), a commercial alcohol consisting essentially of primary alcohols having from 12 to 18 carbon atoms (56.6 parts) and a commercial alcohol consisting of primary alcohols having from 8 to 10 carbon atoms (10 parts) and to the resulting mixture there is added 96% sulfuric acid (2.3 parts). The mixture is then heated at 150°–160° C. for 20 hours whereupon water is distilled off. An additional amount of sulfuric acid (0.18 part) together with an additional amount of n-butyl alcohol (3 parts) is added and the esterification is continued until 95% of the carboxy radicals of the polymer has been esterified. To the esterified interpolymer, there is then added aminopropyl morpholine (3.71 parts; 10% in excess of the stoichiometric amount required to neutralize the remaining free carboxy radicals) and the resulting mixture is heated to 150°–160° C./10 mm. Hg to distill off toluene and any other volatile components. The stripped product is mixed with an additional amount of mineral oil (12 parts) filtered. The filtrate is a mineral oil solution of the nitrogen-containing mixed ester having a nitrogen content of 0.16- 0.17%.

EXAMPLE (B10)-2

The procedure of Example (B10)-1 is followed except that the esterification is carried out in two steps, the first step being the esterification of the styrene-maleic interpolymer with the commercial alcohols having from 8 to 18 carbon atoms and the second step being the further esterification of the interpolymer with n-butyl alcohol.

EXAMPLE (B10)-3

The procedure of Example (B10)-1 is followed except that the esterification is carried out by first esterifying the styrene-maleic interpolymer with the commercial alcohol having from 8 to 18 carbon atoms until 70% of the carboxyl radicals of the interpolymer have been convened to ester radicals and thereupon continuing the esterification with any yet-unreacted commercial alcohols and n-butyl alcohol until 95% of the carbonyl radicals of the interpolymer have been converted to ester radicals.

EXAMPLE (B10)-4

The procedure of Example (B10)-1 is followed except that the interpolymer is prepared by polymerizing a solution consisting of styrene (416 parts), maleic anhydride (392 parts), benzene (2153 parts) and toluene (5025 parts) in the presence of benzoyl peroxide (1.2 parts) at 65°–106° C. (The resulting interpolymer has a reduced specific viscosity of 0.45).

EXAMPLE (B10)-5

The procedure of Example (B10)-1 is followed except that the styrene-maleic anhydride is obtained by polymerizing a mixture of styrene (416 parts), maleic anhydride (392 parts), benzene (6101 parts) and toluene (2310 parts) in the presence of benzoyl peroxide (1.2 parts) at 78°–92° C. (The resulting interpolymer has a reduced specific viscosity of 0.91).

EXAMPLE (B10)-6

The procedure of Example (B10)-1 is followed except that the styrene-maleic anhydride is prepared by the following procedure: Maleic anhydride (392 parts) is dissolved in benzene (6870 parts). To this mixture there is added styrene (416 parts) at 76° C. whereupon benzoyl peroxide (1.2 parts) is added. The polymerization mixture is maintained at 80°–82° C. for about 5 hours. (The resulting interpolymer has a reduced specific viscosity of 1.24.)

EXAMPLE (B10)-7

The procedure of Example (B10)-1 is followed except that acetone (1340 parts) is used in place of benzene as the polymerization solvent and that azobisisobutyronitrile (0.3 part) is used in place of benzoyl peroxide as a polymerization catalyst.

EXAMPLE (B10)-8

An interpolymer (0.86 carboxyl equivalent) of styrene and maleic anhydride (prepared from an equal molar mixture of styrene and maleic anhydride and having a reduced specific viscosity of 0.69) is mixed with mineral oil to form a slurry, and then esterified with a commercial alcohol mixture (0.77 mole; comprising primary alcohols having from 8 to 18 carbon atoms) at 150°–160° C. in the presence of a catalytic amount of sulfuric acid until about 70% of the carboxyl radicals are converted to ester radicals. The partially esterified interpolymer is then further esterified with a n-butyl alcohol (0.31 mole) until 95% of the carboxyl radicals of the interpolymer are converted to the mixed ester radicals. The esterified interpolymer is then treated with aminopropyl morpholine (slight excess of the stoichiometric amount to neutralize the free carboxyl radicals of the interpolymer) at 150°–160° C. until the resulting product is substantially neutral (acid number of 1 to phenolphthalein indicator). The resulting product is mixed with mineral oil so as to form an oil solution containing 34% of the polymeric product.

(B11) The Hydrogenated Block Copolymer

Considering the (B11) hydrogenated block copolymer, it comprises either a normal block copolymer, that is a true block copolymer or a random block copolymer. Considering the true or normal block copolymer, it is generally made from conjugated dienes having from 4 to 10 carbon atoms and preferably from 4 to 6 carbon atoms as well as from vinyl substituted aromatics having from 8 to 12 carbon atoms and preferably 8 or 9 carbon atoms.

Examples of vinyl substituted aromatics include styrene, alpha-methylstyrene, ortho-methylstyrene, meta-methylstyrene, para-methylstryrene, para-tertiary-butylstyrene, with styrene being preferred. Examples of such conjugated dienes include piperylene, 2,3-dimethyl-1,3-butadiene, chloroprene, isoprene and 1, 3-butadiene with isoprene and 1,3-butadiene being particularly preferred. Mixtures of such conjugated dienes are useful.

The normal block copolymers have a total of from 2 to about 5, and preferably 2 or 3, polymer blocks of the vinyl substituted aromatic and the conjugated diene with at least one polymer block of said vinyl substituted aromatic and at least one polymer block of said conjugated dienes being present. The conjugated diene block is hydrogenated as more fully set forth hereinbelow. The normal block copolymers can be linear block copolymers wherein a substantially long sequence of one monomeric unit (Block I) is linked with another substantially long sequence of a second (Block II), third (Block III), fourth (Block IV), or fifth (Block V) monomeric unit. For example, if a is a styrene monomeric unit and d is a conjugated diene monomeric unit, a tri-block copolymer of these monomeric unit can be represented by the formula:

aaaa - - - aa—ddd - - - ddd—aaa - - - aa

Block IBlock II Block III
Linear A B A Block

These copolymers can also be radial block copolymers wherein the polymer blocks are linked radically as represented by the formula:

aaa - - - aa - - - aa - - - aaa
|
ddd - - - ddd

Radial A B Block

In practice, the number of repeat units involved in each polymer block usually exceeds about 500, but it can be less than about 500. The sequence length in one block should be long enough so that the block copolymer exhibits the inherent homopolymeric physical properties such as glass transition temperature and polymer melt temperature.

The vinyl substituted aromatic content of these copolymers, that is the total amount of vinyl substituted aromatic blocks in the normal block copolymer, is in the range of from about 20 percent to about 70 percent by weight and preferably from about 40 percent to about 60 percent by weight. Thus, the aliphatic conjugated diene content, that is the total diene block content, of these copolymers is in the range of from about 30 percent to about 80 percent by weight and preferably from about 40 percent to about 60 percent by weight.

These normal block copolymers can be prepared by conventional methods well known in the art. Such copolymers usually are prepared by anionic polymerization using, for example, an alkali metal hydrocarbon (e.g., sec-butyllithium) as a polymerization catalyst.

Examples of suitable normal block copolymers as set forth above include Shellvis-40 and Shellvis-50, both hydrogenated styrene-isoprene block copolymers, manufactured by Shell Chemicals.

Considering the random block copolymer which can be utilized separately, in combinations with the normal block copolymers set forth above, or not at all, it is generally defined as a block copolymer having one or more block polymer portions therein. More specifically, the random block copolymers can be defined as an indeterminate number of a and d blocks of indeterminate lengths. These random copolymers are generally made from conjugated dienes of the type noted above and hereby incorporated by reference with butadiene or isoprene being preferred. The remaining monomer utilized to make the random block copolymer comprises vinyl substituted aromatics of the type set forth hereinabove and are also hereby fully incorporated by reference. A suitable type of aromatic monomer is styrene. The random block copolymer can be made by simultaneously feeding a mixture of monomers to a polymerization system rather than by feeding the monomers in a sequential manner. The amount of the various blocks by weight are the stone as set forth above, that is from about 20 to about 70 percent by weight of vinyl substituted aromatic block with 40 to 60 percent by weight of such blocks being preferred. Accordingly, the amount of the diene blocks is the difference. The number average molecular weight and the weight average molecular weight of the random block copolymers are the same as set forth above and accordingly are hereby fully incorporated by reference. The random block copolymers contain significant blocks of a vinyl substituted aromatic repeating unit and/or significant blocks of a conjugated diene repeating unit therein and/or blocks of random or random tapered conjugated diene/vinyl substituted aromatic. These copolymer can also be represented as by A'-B'-A'-B'- wherein A' is a block of vinyl substituted aromatic compound. B' is a block of conjugated diene, and the length of A' and B' blocks vary widely and, are substantially shorter than the A and B blocks of a normal block copolymer. The amount of the aromatic A block content of the random block copolymer preferably should be in the range of about 15 to about 45, more preferably 25 to about 40 weight percent.

Examples of such commercially available random block copolymers include the various Glissoviscal block copolymers manufactured by BASF. A previously available random block copolymer was Phil-Ad viscosity improver, manufactured by Phillips Petroleum.

Regardless of whether a true (normal block) copolymer or a random block copolymer, or combinations of both are utilized, they are hydrogenated before use so as to remove virtually all of their olefinic double bonds. Techniques for accomplishing this hydrogenation are well know to those of skill in the art and need not be described in detail at this point. Briefly, hydrogenation is accomplished by contacting the copolymers with hydrogen at superatomospheric pressures in the presence of a metal catalyst such as colloidal nickel, palladium on charcoal, etc.

In general, it is preferred that these block copolymers, for reasons of oxidative stability, contain no more than about 5 percent and preferably no more than about 0.5 percent residual olefinic unsaturation on the basis of the total number of carbon-to-carbon covalent linkages within the average molecule. Such unsaturation can be measured by a number of means well known to those of skill in the art, such as infrared, NMR, etc. Most preferably, these copolymers contain no discernible unsaturation as determined by the afore-mentioned analytical techniques.

The (B11) block copolymers typically have number average molecular weight in the range of about 5,000 to about 1,000,000 preferably about 30,000 to about 200,000. The weight average molecular weight for these copolymers is generally in the range of about 50,000 to about 500,000, preferably about 30,000 to about 300,000.

(B12) The Acrylate Polymer

The acrylate polymer of the formula

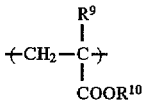

wherein $R^9$ is hydrogen or a lower alkyl group containing from 1 to about 4 carbon atoms, $R^{10}$ is a mixture of alkyl, cycloalkyl or aromatic groups containing from about 4 to about 24 carbon atoms, and x is an integer providing a weight average molecular weight (Mw) to the acrylate polymer of about 5000 to about 1,000,000.

Preferably $R^9$ is a methyl or ethyl group and more preferably, a methyl group. $R^{10}$ is primarily a mixture of alkyl groups containing from 4 to about 18 carbon atoms. In one embodiment, the weight average molecular weight of the acrylate polymer is from about 50,000 to about 500,000 and in other embodiments, the molecular weight of the polymer may be from 100,000 to about 500,000 and 300,000 to about 500,000.

Specific examples of the alkyl groups $R^{10}$ which may be included in the polymers of the present invention include, for example, n-butyl, octyl, decyl, dodecyl, tridecyl, octadecyl, hexadecyl, octadecyl. The mixture of alkyl groups can be varied so long as the resulting polymer is hydrocarbon-soluble.

The following examples are illustrative of the preparations of the acrylate polymers of the present invention. All parts and percentages are by weight unless indicated to the contrary.

EXAMPLE (B12)-1

Added to a 2 liter 4 neck flask is 50.8 parts (0.20 moles) lauryl methacrylate, 44.4 parts (0.20) isobornyl methacrylate, 38.4 parts (0.20 moles) 2-phenoxy ethyl acrylate, 37.6 parts (0.20 moles) 2-ethylhexyl acrylate, 45.2 parts (0.20 moles) isodecyl methacrylate and 500 parts toluene. At 100° C. 1 parts Vazo® 67 (2,2' azobis(2-methylbutyronitrile)) in 20 parts toluene is added over 7 hours. The reaction is held at 100° C. for 16 hours after which the temperature is increased to 120° C. to remove toluene and added is 216 parts of Sunyl® 80 oil, a high oleic vegetable oil available from SVO Enterprises, Eastlake, Ohio. Volatiles are removed by vacuum distillation at 20 millimeters mercury at 140° C. The contents are filtered to give the desired product.

EXAMPLE (B12)-2

Added to a 2 liter 4 neck flask is 38.1 parts (0.15 moles) lauryl methacrylate, 48.6 parts (0.15 moles) stearyl acrylate, 28.2 parts (0.15 moles) 2-ethylhexyl methacrylate, 25.5 parts (0.15 moles) tetrahydrofurfuryl methacrylate, 33.9 parts (0.15 moles) isodecyl methacrylate and 500 parts toluene. At 100° C. 1 part Vazo® 67 in 20 parts toluene is added dropwise in 6 hours. After the addition is complete, the reaction mixture is held at 100° C. for 15.5 hours, toluene is distilled out and 174 parts Sunyl® 80 oil is added. The contents are vacuum stripped at 140° C. at 20 millimeters of mercury and filtered to give the desired product.

An example of a commercially available methacrylate ester polymer which has been found to be useful in the present invention is sold under the tradename of "Acryloid 702" by Rohm and Haas, wherein $R^{10}$ is predominantly a mixture of n-butyl, tridecyl, and octadecyl groups. The weight average molecular weight (Mw) of the polymer is about 404,000 and the number average molecular weight (Mn) is about 118,000. Another commercially available methacrylate polymer useful in the present invention is available under the tradename of "Acryloid 954" by Rohm and Haas, wherein $R^6$ is predominantly a mixture of n-butyl, decyl, tridecyl, octadecyl, and tetradecyl groups. The weight average molecular weight of Acryloid 954 is found to be about 440,000 and the number average molecular weight is about 111,000. Each of these commercially available methacrylate polymers is sold in the form of a concentrate of about 40% by weight of the polymer in a light-colored mineral lubricating oil base. When the polymer is identified by the tradename, the amount of material added is intended to represent an amount of the commercially available Acryloid material including the oil.

Other commercially available polymethacrylates are available from Rohm and Haas Company as Acryloid 1253, Acryloid 1265, Acryloid 1263, Acryloid 1267, from Rohm GmbH as Viscoplex 0-410, Viscoplex 10-930, Viscoplex 5029, from Societe Francaise D'Organo-Synthese as Garbacryl T-84, Garbacryl T-78S, from Texaco as TLA 233, TLA 5010 and TC. 10124. Some of these polymethacrylates may be PMA/OCP (olefin copolymer) type polymers.

The compositions of this invention, components (A) and (B) may further contain (C) at least one oil selected from the group consisting of (1) a vegetable oil or synthetic triglyceride oil of the formula

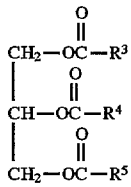

wherein $R^3$, $R^4$ and $R^5$ are aliphatic groups or hydroxy containing aliphatic groups that contain from about 7 to about 23 carbon atoms;

(2) a synthetic ester base oil comprising the reaction of a monocarboxylic acid of the formula $R^{54}COOH$ or a dicarboxylic acid of the formula

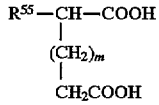

or an aryl carboxylic acid of the formula $R^{21}—Ar(COOH)_p$ wherein $R^{54}$ is a hydrocarbyl group containing from about 4 to about 24 carbon atoms, $R^{55}$ is hydrogen or a hydrocarbyl group containing from about 4 to about 50 carbon atoms, $R^{21}$ is hydrogen or a hydrocarbyl group containing from 1 up to about 24 carbon atoms, m is an integer of from 0 to about 8, and p is an integer of from 1 to 4; with an alcohol of the formula $$R^{22}[O(CH_2\overset{\overset{R^{23}}{|}}{C}HO)_gH]_f$$

wherein $R^{22}$ is an aliphatic, alkoxy or hydroxyalkoxy group containing from 1 to about 30 carbon atoms or an aromatic group containing from 6 to about 18 carbon atoms, $R^{23}$ is hydrogen or an alkyl group containing 1 or 2 carbon atoms, g is from 0 to about 40 and f is from 1 to about 6;

(3) a polyalphaolefin; and (4) a mineral oil.

(C1) The Vegetable Oil or Synthetic Triglyceride Oil

Component (C1) is a vegetable oil, a genetically modified vegetable oil or synthetic triglyceride oil of the formula $$\begin{array}{l} CH_2-OC(=O)-R^1 \\ | \\ CH-OC(=O)-R^2 \\ | \\ CH_2-OC(=O)-R^3 \end{array}$$

Within the triglyceride formula are aliphatic hydrocarbyl groups $R^1$, $R^2$, and $R^3$ that contain from about 7 to about 23 carbon atoms. The term "hydrocarbyl group" as used herein denotes a radical having a carbon atom directly attached to the remainder of the molecule. The aliphatic hydrocarbyl groups include the following:

(1) Aliphatic hydrocarbon groups; that is, alkyl groups such as heptyl, nonyl, decyl, undecyl, tridecyl, heptadecyl, octyl; alkenyl groups containing a single double bond such as heptenyl, nonenyl, undecenyl, tridecenyl, heptadecenyl, heneicosenyl; alkenyl groups containing 2 or 3 double bonds such as 8,11-heptadecadienyl and 8,11,14-heptadecatrienyl, and alkynyl groups containing triple bonds. All isomers of these are included, but straight chain groups are preferred.

(2) Substituted aliphatic hydrocarbon groups; that is groups containing non-hydrocarbon substituents which, in the context of this invention, do not alter the predominantly hydrocarbon character of the group. Those skilled in the art will be aware of suitable substituents; examples are hydroxy, carbalkoxy, (especially lower carbalkoxy) and alkoxy (especially lower alkoxy), the term, "lower" denoting groups containing not more than 7 carbon atoms.

(3) Hetero groups; that is, groups which, while having predominantly aliphatic hydrocarbon character within the context of this invention, contain atoms other than carbon present in a chain or ring otherwise composed of aliphatic carbon atoms. Suitable hetero atoms will be apparent to those skilled in the art and include, for example, oxygen, nitrogen and sulfur.

The vegetable oils comprise sunflower oil, safflower oil, corn oil, soybean oil, rapeseed oil, coconut oil, lesquerella oil, castor oil, canola oil, or peanut oil as well as any hydrogenated vegetable oil varieties. The synthetic triglycerides are those formed by the reaction of one mole of glycerol with three moles of a fatty acid or mixture of fatty acids that contain from 8 to 22 carbon atoms.

Within the genetically modified vegetable oils, the fatty acid moieties are such that the triglyceride has a monounsaturated character of at least 60 percent, preferably at least 70 percent and most preferably at least 80 percent. Naturally occurring triglycerides having utility in this invention are exemplified by vegetable oils that are genetically modified such that oil produced by the plants contain a higher than normal oleic acid content. Normal sunflower oil has an oleic acid content of 18–40 percent. By genetically modifying the sunflower plants, a sunflower oil can be obtained wherein the oleic content is from about 60 percent up to about 92 percent. That is, the $R^1$, $R^2$ and $R^3$ groups are heptadecenyl groups and the $R^1COO^-$, $R^2COO^-$, and $R^3COO^-$, the fatty acid moieties, that are attached to the 1,2,3-propanetriyl group—$CH_2CHCH_2$— are the residue of an oleic acid molecule. U.S. Pat. Nos. 4,627,192 and 4,743,402 are herein incorporated by reference for their disclosure to the preparation of high oleic sunflower oil.

For example, a triglyceride comprised exclusively of an oleic acid moiety has an oleic acid content of 100% and consequently a monounsaturated content of 100%. Where the triglyceride is made up of acid moieties that are 70% oleic acid, 10% stearic acid, 13% palmitic acid, and 7% linoleic, the monounsaturated content is 70%. The preferred triglyceride oils are high oleic (at least 60 percent) acid triglyceride oils. Typical high oleic vegetable oils employed within the instant invention are high oleic safflower oil, high oleic peanut oil, high oleic corn oil, high oleic canola oil, high oleic rapeseed oil, high oleic sunflower oil, high oleic soybean oil, high oleic cottonseed oil, high oleic lesquerella oil and high oleic palm olein. A preferred high oleic vegetable oil is high oleic sunflower oil obtained from Helianthus sp. This product is available from SVO Enterprises Eastlake, Ohio as Sunyl® high oleic sunflower oil. Sunyl 80 oil is a high oleic triglyceride wherein the acid moieties comprise about 80 percent oleic acid and Sunyl 90 oil is a high oleic triglyceride wherein the acid moieties comprise about 90 percent oleic acid. Another preferred high oleic vegetable oil is high oleic canola oil obtained from *Brassica campestris* or *Brassica napus*, also available from SVO Enterprises. RS80 oil signifies a rapeseed oil wherein the acid moieties comprise about 80 percent oleic acid.

It is to be noted the olive oil is excluded as a genetically modified vegetable oil (A) in this invention. The oleic acid content of olive oil typically ranges from 65–85 percent. This content, however, is not achieved through genetic modification, but rather is naturally occurring.

It is further to be noted that genetically modified vegetable oils have high oleic acid contents at the expense of the di-and tri- unsaturated acids. A normal sunflower oil has from 20–40 percent oleic acid moieties and from 50–70 percent linoleic acid moieties. This gives a 90 percent content of mono- and di- unsaturated acid moieties (20+70) or (40+50). Genetically modifying vegetable oils generate a low di- or tri-unsaturated moiety vegetable oil. The genetically modified oils of this invention have an oleic acid moiety:linoleic acid moiety ratio of from about 2 up to about 90. A 60 percent oleic acid moiety content and 30 percent linoleic acid moiety content of a triglyceride oil gives a ratio of 2. A triglyceride oil made up of an 80 percent oleic acid moiety and 10 percent linoleic acid moiety gives a ratio of 8. A triglyceride oil made up of a 90 percent oleic acid moiety and 1 percent linoleic acid moiety gives a ratio of 90. The ratio for normal sunflower oil is about 0.5 (30 percent oleic acid moiety and 60 percent linoleic acid moiety).

(C2) The Synthetic Ester Base Oil

The synthetic ester base oil (C2) comprises the reaction of a monocarboxylic acid of the formula $R^{54}COOH$, a dicarboxylic acid of the formula

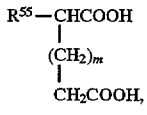

or an aryl carboxylic acid of the formula $R^{56}$—$Ar(COOH)_p$ wherein $R^{54}$ is a hydrocarbyl group containing from about 4 to about 24 carbon atoms, $R^{55}$ is hydrogen or a hydrocarbyl group containing from about 4 to about 50 carbon atoms, $R^{56}$ is hydrogen or a hydrocarbyl group containing from 1 up to about 24 carbon atoms, m is an integer of from 0 to about 8, and p is an integer of from 1 to 4; with an alcohol of the formula

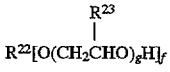

wherein $R^{22}$ is an aliphatic, alkoxy or hydroxy alkoxy group containing from 1 to about 30 carbon atoms or an aromatic group containing from 6 to about 18 carbon atoms, $R^{23}$ is hydrogen or an alkyl group containing 1 or 2 carbon atoms, g is from 0 to about 40 and f is from 1 to about 6.

Within the monocarboxylic acid, $R^{54}$ preferably contains from about 6 to about 18 carbon atoms. An illustrative but non-exhaustive list of monocarboxylic acids are the isomeric carboxylic acids of butanoic acid, hexanoic acid, octanoic acid, nonanoic acid, decanoic acid, undecanoic acid, dodecanoic acid, palmitic acid, and stearic acid. Alkenyl carboxylic acids including oleic acid, linoleic acid, linolenic acid, ricinoleic acid and 14-hydroxy-11-eicosenic acid can also be utilized.

Within the dicarboxylic acid, $R^{55}$ preferably contains from about 4 to about 24 carbon atoms and m is an integer of from 1 to about 3. An illustrative but non-exhaustive list of dicarboxylic acids are succinic, glutaric, adipic, pimelic, suberic, azelaic, sebacic, maleic, and fumaric acids.

As aryl carboxylic acids, $R^{21}$ preferably contains from about 6 to about 18 carbon atoms and p is 2. Aryl carboxylic acids having utility are benzoic, toluic, ethylbenzoic, phthalic, isophthalic, terephthalic, hemimellitic, trimellitic, trimeric, and pyromellitic acids.

Within the alcohols, $R^{22}$ preferably contains from about 3 to about 18 carbon atoms and g is from 0 to about 20. The alcohols may be monohydric, polyhydric or alkoxylated monohydric and polyhydric. Monohydric alcohols can comprise, for example, primary and secondary alcohols. The preferred monohydric alcohols, however are primary aliphatic alcohols, especially aliphatic hydrocarbon alcohols such as alkenols and alkanols. Examples of the preferred monohydric alcohols from which $R^{22}$ is derived include 1-octanol, 1-decanol, 1-dodecanol, 1-tetradeconal, 1-hexadecanol, 1-octadecanol, oleyl alcohol, linoleyl alcohol, linolenyl alcohol, phytol, myricyl alcohol lauryl alcohol, myristyl alcohol, cetyl alcohol, stearyl alcohol, and behenyl alcohol.

Examples of polyhydric alcohols are those containing from 2 to about 6 hydroxy groups. They are illustrated, for example, by the alkylene glycols such as ethylene glycol, diethylene glycol, triethylene glycol, tetraethylene glycol, dipropylene glycol, tripropylene glycol, dibutylene glycol, tributylene glycol, and other alkylene glycols. A preferred class of alcohols suitable for use in this invention are those polyhydric alcohols containing up to about 12 carbon atoms. This class of alcohols includes glycerol, erythritol, trimethylolpropane (TMP), pentaerythritol, dipentaerythritol, gluconic acid, glyceraldehyde, glucose, arabinose, 1,7-heptanediol, 2,4-heptanediol, 1,2,3-hexanetriol, 1,2,4-hexanetriol, 1,2,5-hexanetriol, 2,3,4-hexanetriol, 1,2,3-butanetriol, 1,2,4-butanetriol, quinic acid, 2,2,6,6-tetrakis (hydroxymethyl) cyclohexanol, 1-10-decanediol, digitaloal, and the like.

Another preferred class of polyhydric alcohols for use in this invention are the polyhydric alcohols containing 3 to 10 carbon atoms and particularly those containing 3 to 6 carbon atoms and having at least three hydroxyl groups. Such alcohols are exemplified by a glycerol, erythritol, pentaerythritol, mannitol, sorbitol, 2-hydroxymethyl-2-methyl-1,3,propanediol (trimethylolpropane), bis-trimethylol propane, 1,2,4-hexanetriol and the like.

The alkoxylated alcohols may be alkoxylated monohydric alcohols or alkoxylated polyhydric alcohols. The alkoxy alcohols are generally produced by treating an alcohol with an excess of an alkylene oxide such as ethylene oxide or propylene oxide. For example, from about 6 to about 40 moles of ethylene oxide or propylene oxide may be condensed with an aliphatic alcohol.

In one embodiment, the aliphatic alcohol contains from about 14 to about 24 carbon atoms and may be derived from long chain fatty alcohols such as stearyl alcohol or oleyl alcohol.

The alkoxy alcohols useful in the reaction with the carboxylic acids to prepare synthetic esters are available commercially under such trade names as "TRITON®", "TERGITOL®" from Union Carbide, "ALFONIC®" from Vista Chemical, and "NEODOL®" from Shell Chemical Company. The TRITON® materials are identified generally as polyethoxylated alkyl phenols which may be derived from straight chain or branched chain alkyl phenols. The TERGITOLS® are identified as polyethylene glycol ethers of primary or secondary alcohols; the ALFONIC® materials are identified as ethyoxylated linear alcohols which may be represented by the general structure formula $CH_3(CH_2)_xCH_2(OCH_2CH_2)_nOH$ wherein x varies between 4 and 16 and n is a number between about 3 and 11. Specific examples of ALFONIC® ethoxylates characterized by the above formula include ALFONIC® 1012-60 wherein x is about 8 to 10 and n is an average of about 5.7; ALFONIC® 1214-70 wherein x is about 10–12 and n is an average of about 10.6; ALFONIC® 1412-60 wherein x is from 10–12 and n is an average of about 7; and ALFONIC® 1218-70 wherein x is about 10–16 and n is an average of about 10.7.

The NEODOL® ethoxylates are ethoxylated alcohols wherein the alcohols are a mixture of linear and branched alcohols containing from 9 to about 15 carbon atoms. The ethoxylates are obtained by reacting the alcohols with an excess of ethylene oxide such as from about 3 to about 12 or more moles of ethylene oxide per mole of alcohol. For example, NEODOL® ethoxylate 23-6.5 is a mixed linear and branched chain alcoholate of 12 to 13 carbon atoms with an average of about 6.5 ethoxy units.

As stated above, the synthetic ester base oil comprises reacting any above-identified acid or mixtures thereof with any above-identified alcohol or mixtures thereof at a ratio of 1 COOH per 1 OH group using esterification procedures, conditions and catalysts known in the art.

A non-exhaustive list of companies that produce synthetic esters and their trade names are BASF as Glissofluid, Ciba-Geigy as Reolube, ICI as Emkarate, Oleofina as Radialube and the Emery Group of Henkel Corporation as Emery.

(C3) The Polyalpha Olefins

The polyalphaolefins utilized in this invention are the poly (1-alkenes) wherein the alkene is at least a butene up to about tetracosene. An illustrative but non-exhaustive list includes poly (1-hexenes), poly (1-octenes), poly (1-decenes) and poly (1-dodecenes) and mixtures thereof.

(C4) The Mineral Oil

The mineral oils having utility are mineral lubricating oils such as liquid petroleum oils and solvent-treated or acid-treated mineral lubricating oils of the paraffinic, naphthenic or mixed paraffinic-naphthenic types. Also useful are petroleum distillates such as VM&P naphtha and Stoddard solvent. Oils of lubricating viscosity derived from coal or shale are also useful. Synthetic lubricating oils include hydrocarbon oils and halosubstituted hydrocarbon oils such as polymerized and interpolymerized olefins (e.g., polybutylenes, polypropylenes, propyleneisobutylene copolymers, chlorinated polybutylenes, etc.); poly(1-hexenes), poly(1-octenes), poly(1-decenes). etc. and mixtures thereof; alkylbenzenes (e.g., dodecylbenzenes, tetradecylbenzenes, dinonylbenzenes, di-(2-ethylhexyl)benzenes, etc.); polyphenyls (e.g., biphenyls, terphenyls, alkylated polyphenyls, etc.); alkylated diphenyl ethers and alkylated diphenyl sulfides and the derivatives, analogs and homologs thereof and the like.

Unrefined, refined and rerefined oils, (as well as mixtures of two or more of any of these) can also be used in the present invention. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be an unrefined oil. Refined oils are similar to the unrefined oils except they have been further treated in one or more purification steps to improve one or more properties. Many such purification techniques are known to those skilled in the art such as solvent extraction, secondary distillation, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives and oil breakdown products.

The composition of the present invention comprising components (A) and (B) or (A), (B) and (C) are useful as stable biodegradable lubricant compositions.

As a formulated lubricating composition within the present invention, when the composition comprises components (A) and (B), the (A):(B) weight ratio is generally from 75:25 to 99.9:0.1, preferably from 80:20 to 99.5:0.5 and most preferably from 85:15 to 99:1.

As a formulated lubricating composition within the present invention when the composition comprises components (A), (B) and (C), the following states the ranges of these components in parts by weight.

| Component | Generally | Preferred | Most Preferred |
|---|---|---|---|
| (A) | 9–90 | 70–90 | 80–90 |
| (B) | 0.1–10 | 0.1–8 | 0.1–5 |
| (C) | 9–50 | 10–30 | 10–20 |

It is also to be recognized that concentrates of the invention can be formed. The concentrates comprise a minor amount of (A) with a major amount of (B) or a minor amount of (A) with a major amount of the combination of (B) and (C).

The term "minor amount" as used in the specification and appended claims is intended to mean that when a composition contains a "minor amount" of a specific material that amount is less than 50 percent by weight of the composition.

The term "major amount" as used ini the specification and appended claims is intended to mean that when a composition contains a "major amount" of a specific material that amount is more than 50 percent by weight of the composition.

Table I shows the poor oxidation properties of the hydrogenated polyisoprene (A) and the improved oxidation properties obtained by including a preformance additive (B). Table I further shows the poor oxidation properties of a blend of the hydrogenated polyisoprene (A) and oil (C) and the improved oxidation properties obtained by the inclusion of a performance additive (B).

TABLE I

EFFECTS OF PERFORMANCE ADDITIVES ON HYDROGENATED POLYISOPRENE OR ON BLENDS OF HYDROGENATED POLYISOPRENES AND OILS IN THE ROTARY BOMB OXIDATION TEST (RBOT)

| Example No. | Component A | Component B | Component C | RBOT (Minutes) |
|---|---|---|---|---|
| 1 | 100 parts Squalane | | | 26 |
| 2 | 98 parts Squalane | 2 parts di-t-butylphenol | | 684 |
| 3 | 97 parts Squalane | 3 parts di-t-butylphenol | | 523 |
| 4 | 96.95 parts Squalane | 3 parts di-t-butylphenol 0.05 parts tolyltriazole | | 748 |
| 5 | 98.8 parts Squalane | 1.2 parts nonylated diphenylamine | | 1298 |
| 6 | 98 parts Squalane | 2 parts nonylated diphenylamine | | 1702 |

TABLE I-continued

EFFECTS OF PERFORMANCE ADDITIVES ON HYDROGENATED POLYISOPRENE OR ON BLENDS OF HYDROGENATED POLYISOPRENES AND OILS IN THE ROTARY BOMB OXIDATION TEST (RBOT)

| Example No. | Component A | Component B | Component C | RBOT (Minutes) |
|---|---|---|---|---|
| 7 | 96 parts Squalane | 2 parts di-t-butylphenol<br>2 parts nonylated diphenylamine | | 736 |
| 8 | 90 parts Squalane<br>10 parts LIR-290 | | | 14 |
| 9 | 87.255 parts Squalane<br>9.895 parts LIR-290 | 2 parts di-t-butylphenol<br>0.05 parts tolyltriazole | | 492 |
| 10 | 10 parts Squalane | | 90 parts Sunyl ® 80 Oil | 16 |
| 11 | 9.8 parts Squalane | 2 parts di-t-butylphenol | 88.2 parts Sunyl ® 80 Oil | 167 |
| 12 | 9.795 parts Squalane | 2 parts di-t-butylphenol<br>0.5 parts tolyltriazole | 88.155 parts Sunyl ® 80 Oil | 293 |
| 13 | 30 parts Squalane | | 70 parts Sunyl ® 80 Oil | 14 |
| 14 | 29.4 parts Squalane | 2 parts di-t-butylphenol | 68.6 parts Sunyl ® 80 Oil | 228 |
| 15 | 29.385 parts Squalane | 2 parts di-t-butylphenol<br>0.5 parts tolyltriazole | 68.565 parts Sunyl ® 80 Oil | 362 |
| 16 | 9.7 parts Squalane | 2 parts di-t-butylphenol<br>1 part nonylated diphenylamine | 67.9 parts Sunyl ® 80 Oil | 214 |
| 17 | 50 parts Squalane | | 50 parts Sunyl ® 80 Oil | 14 |
| 18 | 49 parts Squalane | 2 parts di-t-butylphenol | 49 parts Sunyl ® 80 Oil | 300 |
| 19 | 48.975 parts Squalane | 2 parts di-t-butylphenol<br>0.5 parts tolyltriazole | 48.975 parts Sunyl ® 80 Oil | 434 |

While the invention has been explained in relation to its preferred embodiments, it is to be understood that various modifications thereof will become apparent to those skilled in the an upon reading the specification. Therefore, it is to be understood that the invention disclosed herein is intended to cover such modifications as fall within the scope of the appended claims.

What is claimed is:

1. An oxidatively stable, biodegradable lubricant composition, comprising:

(A) at least one hydrogenated polyisoprene prepared by polymerizing isoprene such that polyisoprene is obtained wherein there are from 4 to 1000 isoprene units wherein the polyisoprene prior to hydrogenation has the formula I. $H\text{-}(CH_2\overset{CH_3}{\overset{|}{C}}{=}CHCH_2)_n\text{-}H$ or II. $[H\text{-}(CH_2\overset{CH_3}{\overset{|}{C}}{=}CHCH_2)_{n/2}]_2$ wherein n is the number of isoprene units and hydrogenating the polyisoprene to obtain a hydrogenated polyisoprene containing a residual olefinic unsaturation of not more than 10 percent based upon the unsaturation content prior to hydrogenation and;

(B) at least one performance additive selected from the group consisting of (1) an alkyl phenol of the formula

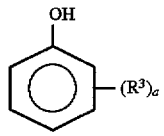

wherein $R^3$ is an alkyl group containing from 1 up to about 24 carbon atoms and a is an integer of from 1 up to 5;

(2) an ether of the formula

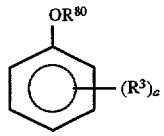

wherein $R^{80}$ is an alkyl group containing from one up to about 12 carbon atoms, $R^3$ is an alkyl group containing from one up to about 24 carbon atoms and a is an integer of from one up to 5; or $R^{75}O\text{-}(CH_2\overset{CH_3}{\overset{|}{C}}HO)_n\text{-}(CH_2CH_2O)_mH$ wherein $R^{75}$ is an aliphatic group containing from one up to 8 carbon atoms, n and m are independently integers of from zero up to 100 with the proviso that n and m are not both zero;

(3) a mixture of a mono- or di-substituted glyceride of the formula:

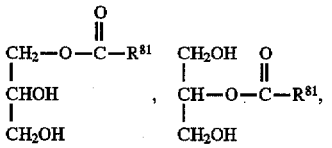

wherein $R^{81}$ and $R^{82}$ are hydrocarbyl groups independently containing from about 8 up to about 24 carbon atoms;

(4) a phosphorus-sulfur derivative of the formula

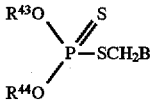

wherein $R^{43}$ and $R^{44}$ are independently hydrocarbyl groups containing from about 3 to about 20 carbon atoms and B is

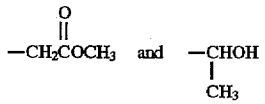

a mixture of

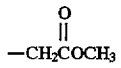

in a ketone:alcohol weight ratio of from 1:0.10–0.50;

(5) a benzotriazole of the formula

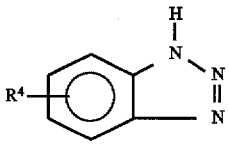

wherein $R^4$ is hydrogen or an alkyl group of 1 up to about 24 carbon atoms;

(6) a phosphorous amine salt;

(7) a trihydrocarbyl phosphorothionate;

(8) an aromatic amine of the formula

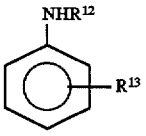

wherein $R^{12}$ is

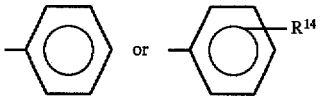

and $R^{13}$ and $R^{14}$ are independently a hydrogen or an alkyl group containing from 1 up to about 23 carbon atoms;

(9) a zinc salt of the formula

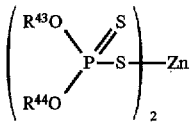

wherein $R^{43}$ and $R^{44}$ are independently hydrocarbyl groups containing from about 3 to 20 carbon atoms;

(10) an ester having pour point depressant properties characterized by low-temperature modifying properties of an ester of a carboxy-containing interpolymer, said interpolymer having a reduced specific viscosity of from about 0.05 to about 2 and being derived from at least two monomers, one of said monomers being a low molecular weight aliphatic olefin, styrene or a substituted styrene wherein the substituent is a hydrocarbyl group containing from 1 up to about 18 carbon atoms, and the other of said monomers being an alpha, beta-unsaturated aliphatic acid, anhydride or ester thereof, said ester being substantially free of titratable acidity and being characterized by the presence within its polymeric structure of pendant polar groups which are derived from the carboxy groups of said ester:

(a) a relatively high molecular weight carboxylic ester group, said carboxylic ester group having at least 8 aliphatic carbon atoms in the ester radical, optionally (b) a relatively low molecular weight carboxylic ester group having no more than 7 aliphatic carbon atoms in the ester radical, wherein the molar ratio of (a):(b) of the pour point depressant when (b) is present is (1–20):1, and optionally (c) a carbonyl-amino group derived from an amino compound having one primary or secondary amino group, wherein the molar ratio of (a):(b):(c) of the pour point depressant when (b) and (c) are present is (50–100):(5–50):(0.1–15);

(11) a hydrogenated block copolymer comprising a normal block copolymer or a random block copolymer, said normal block copolymer made from a vinyl substituted aromatic and an aliphatic conjugated diene, said normal block copolymer having from two to about five polymer blocks with at least one polymer block of said vinyl substituted aromatic and at least one polymer block of said aliphatic conjugated diene, said random block copolymer made from vinyl substituted aromatic and aliphatic conjugated diene monomers, the total amount of said vinyl substituted aromatic blocks in said block copolymer being in the range of from about 20 percent to about 70 percent by weight and the total amount of said diene blocks in said block copolymer being in the range of from about 30 percent to about 80 percent by weight; the number average molecular weight of said normal block copolymer and said random block copolymer being in the range of about 5,000 to about 1,000,000; and

(12) an acrylate polymer of the formula

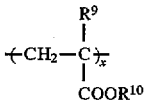

wherein $R^9$ is hydrogen or a lower alkyl group containing from 1 to about 4 carbon atoms, $R^{10}$ is a mixture of alkyl, cycloalkyl or aromatic groups containing from about 1 to about 24 carbon atoms, and x is an integer providing a weight average molecular weight (Mw) to the acrylate polymer of about 5,000 to about 1,000,000.

2. The composition of claim 1 further comprising (C) at least one oil selected from the group consisting of (C3) a polyalphaolefin; and (C4) a mineral oil.

3. The composition of claim 1 wherein the molecular weight or the acrylate polymer is from about 50,000 to about 500,000.

4. The composition of claim 1 wherein the residual olefinic unsaturation is not more than 1 percent.

5. The composition of claim 1 wherein n is not more than 800.

6. The composition of claim 1 wherein within formula I, n is from 200 to 600.

7. The composition of claim 1 wherein within formula I, n is from 5 to 80.

8. The composition of claim 1 wherein within formula II, n is from 2 to 20.

9. The composition of claim 8 wherein n is 6 and formula II is squalene.

10. The composition of claim 1 wherein within (B1), a is 2 and $R^3$ contains from 1 up to 8 carbon atoms.

11. The compositions of claim 10 wherein the alkyl phenol is of the formula

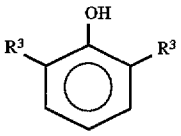

wherein $R^3$ is t-butyl.

12. The composition of claim 1 wherein within (B2), $R^{80}$ contains from 1 up to 8 carbon atoms, $R^3$ contains from 6 to 12 carbon atoms and a is zero or 1.

13. The composition of claim 1 wherein within (B2), $R^{75}$ is a butyl group.

14. The composition of claim 1 wherein within (B3), $R^{81}$ and $R^{82}$ contain from 12 to 18 carbon atoms.

15. The composition of claim 1 wherein within (B5), $R^4$ is hydrogen or an alkyl group containing from 1 up to 8 carbon atoms.

16. The composition of claim 15 wherein $R^4$ is a methyl group.

17. The composition of claim 1 wherein within (B7), the trihydrocarbyl phosphorothionate has the formula

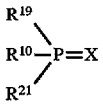

wherein $R^{19}$ $R^{20}$ and $R^{21}$ are independently hydrogen, an aliphatic or alkoxy group containing from 1 up to 12 carbon atoms, or an aryl or aryloxy group wherein the aryl group is phenyl or naphthyl and the aryloxy group is phenoxy or naphthoxy and X is oxygen or sulfur.

18. The composition of claim 17 wherein $R^{19}$, $R^{20}$ and $R^{21}$ are phenoxy groups and X is sulfur.

19. The composition of claim 1 wherein within (B6), the phosphorus amine salt has the formula

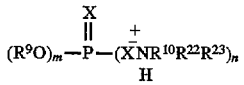

wherein $R^9$ and $R^{10}$ are independently aliphatic groups containing from 4 up to 24 carbon atoms, $R^{22}$ and $R^{23}$ are independently hydrogen or aliphatic groups containing from 1 up to 18 carbon atoms, the sum of m and n is 3 and X is oxygen or sulfur.

20. The composition of claim 19 wherein $R^9$ contains from 4 up to 18 carbon atoms, $R^{22}$ and $R^{23}$ are hydrogen, $R^{10}$ is

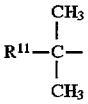

wherein $R^{11}$ is an aliphatic group containing from 6 up to 12 carbon atoms, m is 2, n is and X is oxygen.

21. The composition of claim 1 wherein within (B8), $R^{12}$ is

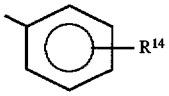

and $R^{13}$ and $R^{14}$ are alkyl groups containing from 4 to 18 carbon atoms.

22. The composition of claim 21 wherein $R^{13}$ and $R^{14}$ are nonyl groups.

23. The composition of claim 1 wherein said ester of the interpolymer is characterized by low-temperature modifying properties of an ester of a carboxy-containing interpolymer, said interpolymer having a reduced specific viscosity of from about 0.05 to about 2 and being derived from at least two monomers, the one being ethylene, propylene, butylene, styrene substituted styrene wherein the substituent is a hydrocarbyl group containing from I up to about 18 carbon atoms, or an alpha olefin that contains from 6 up to 30 carbon atoms and the other of said monomers being maleic acid or anhydride, itaconic acid or anhydride or acrylic acid or ester, said ester being substantially free of titratable acidity and being characterized by the presence within its polymeric structure of at least one of each of three pendant polar groups which are derived from the carboxy groups of said ester:

(a) a relatively high molecular weight carboxylic ester group, said carboxylic ester group having at least 8 aliphatic carbon atoms in the ester radical, (b) a relatively low molecular weight carboxylic ester group having no more than 7 aliphatic carbon atoms in the ester radical, wherein the molar ratio of (a):(b) of the pour point depressant is (1–20):1, and optionally (c) a carbonyl-amino group derived from an amino compound having one primary or secondary amino radical, wherein the molar ratio of (a):(b):(c) of the pour point depressant when (c) is present (50–100):(5–50):(0.1–15).

24. The composition of claim 23 wherein the molar ratio of (a):(b) of the pour point depressant is (1–10):1.

25. The composition of claim 23 wherein the molar ratio of (a):(b):(c) of the pour point depressant is (70–85):(15–30):(3–4).

26. The composition of claim 23 wherein the interpolymer is a styrene-maleic anhydride interpolymer having a reduced specific viscosity of from about 0.1 to about 1.

27. The composition of claim 23 wherein the relatively high molecular weight carboxylic ester group of (a) has from 8 to 24 aliphatic carbon atoms, the relatively low molecular weight carboxylic ester group of (b) has from 3 to 5 carbon atoms and the carbonyl-amino group of (c) is derived from a primary-aminoalkyl-substituted tertiary amine.

28. The composition of claim 23 wherein the carboxy-containing interpolymer is a terpolymer of one molar proportion of styrene, one molar proportion of maleic anhydride, and less than about 0.3 molar proportion of a vinyl monomer.

29. The composition of claim 23 wherein said low molecular weight aliphatic olefin of said nitrogen-containing ester is selected from the group consisting of ethylene, propylene or isobutene.

30. The composition of claim 1 wherein said normal block copolymer has a total of two or three polymer blocks, wherein the number average molecular weight of said normal block and said random copolymer is from about 30,000 to about 200,000, wherein in said block copolymer the total amount of said conjugated diene is from about 40% to about 60% by weight and the total amount of said vinyl substituted aromatic is from about 40% to about 60% by weight.

31. The composition of claim 1 wherein said conjugated diene is isoprene or butadiene, wherein said vinyl substituted aromatic is styrene, and wherein said hydrogenated normal block copolymer and random block copolymer contain no more than 0.5% residual olefinic unsaturation.

32. The composition of claim 1 wherein $R^9$ is a methyl group.

33. A concentrate according to claim 1 which comprises a minor amount of (A) and a major amount of (B).

34. A concentrate according to claim 2 which comprises a minor amount of (A) and a major amount of the combination of (B) and (C).

* * * * *